US006517640B2

(12) United States Patent
Deng

(10) Patent No.: US 6,517,640 B2
(45) Date of Patent: Feb. 11, 2003

(54) VACUUM CLEANER APPARATUS AND RETURN SYSTEM FOR USE WITH THE SAME

(76) Inventor: David Deng, 2668 High Ridge Dr., Chino Hills, CA (US) 91709

( * ) Notice: Subject to any disclaimer, the term of this patent is extended or adjusted under 35 U.S.C. 154(b) by 0 days.

(21) Appl. No.: 10/039,600

(22) Filed: Oct. 19, 2001

(65) Prior Publication Data

US 2002/0053115 A1 May 9, 2002

Related U.S. Application Data

(63) Continuation-in-part of application No. PCT/US00/13372, filed on May 15, 2000.

(51) Int. Cl.[7] ..... A47L 5/14

(52) U.S. Cl. ..... 134/21; 134/37; 15/345; 15/346

(58) Field of Search ..... 15/345, 346; 134/21, 134/37

(56) References Cited

U.S. PATENT DOCUMENTS

| | | | | |
|---|---|---|---|---|
| 2,064,344 A | | 12/1936 | Good | |
| 2,475,808 A | | 7/1949 | Storm, Jr. | |
| 3,268,942 A | | 8/1966 | Rossnan | |
| 3,694,848 A | | 10/1972 | Alcala | |
| 3,942,216 A | | 3/1976 | Minton | |
| 5,485,651 A | | 1/1996 | Payeur | |
| 5,647,092 A | | 7/1997 | Miwa | |
| 6,032,327 A | | 3/2000 | Oka et al. | |
| 6,108,863 A | * | 8/2000 | Lin | 15/344 |
| 6,245,159 B1 | * | 6/2001 | Deng | 134/21 |
| 6,324,722 B1 | * | 12/2001 | Takemoto | 15/346 |
| 2001/0009050 A1 | * | 7/2001 | Fukushima et al. | 15/346 |
| 2001/0027585 A1 | * | 10/2001 | Lee | 15/346 |

FOREIGN PATENT DOCUMENTS

| | | |
|---|---|---|
| CH | 675674 A5 | 10/1990 |
| DE | 3010130 A1 | 9/1981 |
| DE | 4135406 A1 | 5/1992 |
| FR | 88263 | 4/1965 |

* cited by examiner

*Primary Examiner*—Chris K. Moore
(74) *Attorney, Agent, or Firm*—Henricks, Slavin & Holmes LLP

(57) ABSTRACT

A vacuum cleaner that generates an output air stream to agitate dirt and other debris on the surface being cleaned.

22 Claims, 19 Drawing Sheets

14
46
44
84
82
76
53
50
42
80
36
40
54
62
51
78
48
66
38
57
58
60
24a
28
22
24b
20a
26
12
18
20b

B52
B42
B10
B52
B52
B44
B50
B48
B60
B58
B51
B52
B52
B64
B62
B66
B20a
B64
B32a
B36
B30
B32b

VACUUM CLEANER APPARATUS AND RETURN SYSTEM FOR USE WITH THE SAME

CROSS-REFERENCE TO RELATED APPLICATION

This application is a continuation-in-part of co-pending PCT application Serial No. PCT/US00/13372, filed May 15, 2000.

BACKGROUND OF THE INVENTIONS

1. Field of the Inventions

The present inventions generally relate to vacuum cleaners and, more particularly, to vacuum cleaners that utilize air to agitate dirt and debris.

2. Description of the Related Art

Vacuum cleaners are common household appliances that are used to clean and maintain surfaces such as carpets and other floor coverings. Conventional vacuum cleaners include a cleaning head that is drawn over the surface that is being cleaned. Disposed within the cleaning head is a 6 to 12 amp electric motor that rotates a fan at up to 35,000 rpm to generate a low pressure air stream. The motor is coupled to an inlet in the cleaning head through a duct or flexible hose and a dustbin. During operation, the low pressure air stream draws dust, dirt and other debris through the inlet and into the dustbin.

Conventional vacuum cleaners often include an agitator, which consists of a cylindrical roller and a series of brushes, within the cleaning head and next to the inlet in order to facilitate the removal of debris from carpet, floor coverings and other surfaces. The agitator is coupled to the motor with a belt so that operation of the motor causes the agitator to spin at a high rate of speed, thereby brushing and agitating the surface. The agitation dislodges debris and facilitates the drawing of the debris into the inlet. Upright vacuum cleaners typically use a single motor to rotate both the fan and the agitator. Motors that are powerful enough to accomplish both tasks can generate a considerable amount of noise. These motors can also be heavy which makes the vacuums unwieldy and difficult to accurately position over the surface being cleaned.

The configuration of conventional vacuum cleaners is also such that the removal of dirt and debris from the edges of walls and obstacles like furniture, which rest directly on the surface being cleaned, can only be accomplished through the use of accessory hoses and adapter pieces. The inventor herein has determined that accessory hoses and adapter pieces can be inconvenient and add to the cumbersome nature of conventional vacuum cleaners.

SUMMARY OF THE INVENTIONS

The present inventions address the aforementioned deficiencies in conventional vacuum cleaners by using exhaust air to agitate dirt and other debris on the surface being cleaned, as well as along the edges of walls and obstacles on the surface being cleaned, instead of (or possibly in addition to) a conventional agitator. As such, the present vacuum cleaners may be provided with a smaller motor than conventional vacuum cleaners, which increases efficiency and reduces noise.

In accordance with one embodiment of a present invention, a motor assembly is provided that includes an intake port and an exhaust port. An input air stream is drawn through the intake port and an output air stream is generated through the exhaust port. The motor assembly intake port is also in fluid communication with an inlet through which debris is drawn that is located adjacent to the surface being cleaned. An outlet, which is in fluid communication with the motor assembly exhaust port, is located adjacent to both the inlet and the surface being cleaned. The outlet directs the output air stream onto the surface to agitate dirt and other debris.

In accordance with one embodiment of a present invention, a motor assembly include a motor, an ambient air intake port, an air intake port, and an air exhaust port. A first air transmission apparatus, operably connected to the air intake port, includes a first air inlet adjacent to the surface and operably connected to a debris collection area and a first air outlet. A second air transmission apparatus, operably connected to the air exhaust port, includes a second air outlet that directs air from the air exhaust port to the surface. A chamber, operably connected to the first air outlet, combines the air from the first air outlet with ambient air from the ambient air intake port to form a combined air stream. The combined air stream is directed onto the surface being cleaned to agitate dirt and other debris.

In accordance with one embodiment of a present invention, a filter and dustbin may be positioned between the inlet and the intake port of the motor assembly to collect and filter dirt and other debris in the input air stream before it exits by way of the outlet.

In accordance with one embodiment of a present invention, the outlet includes a plurality of forward deflection channels that direct the output stream in front of the vacuum cleaner and a plurality of rear deflection channels direct the output stream towards the inlet. A selector to direct the output stream through either the forward or rearward deflection channels may also be provided.

In accordance with additional embodiments of the present inventions, the inventions herein may be incorporated into air return attachments for use in conventional vacuum cleaners.

In accordance with one embodiment of a present invention, a method of cleaning a surface includes the steps of generating a input stream of air through an inlet of the vacuum with vacuum's motor assembly. The dirt and debris is drawn into the inlet with the input stream and removed by a filter. The input stream is then converted into an output stream by the motor assembly and directed onto the floor with an outlet. The combined air stream facilitates cleaning of the floor by agitating dirt and other debris.

In accordance with one embodiment of a present invention, a method of cleaning a surface includes the steps of directing an intake air stream through a debris collection area, drawing ambient air, generating an output air stream with the ambient air, combining the intake air stream with the output air stream to form a combined air stream, and directing the combined air stream through an output outlet adjacent to the surface. The combined air stream facilitates cleaning of the floor by agitating dirt and other debris.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known modes of carrying out the inventions. This description is not to be taken in a limiting sense, but is made merely for the purpose of illustrating the general principles of the inventions.

Figure 1:
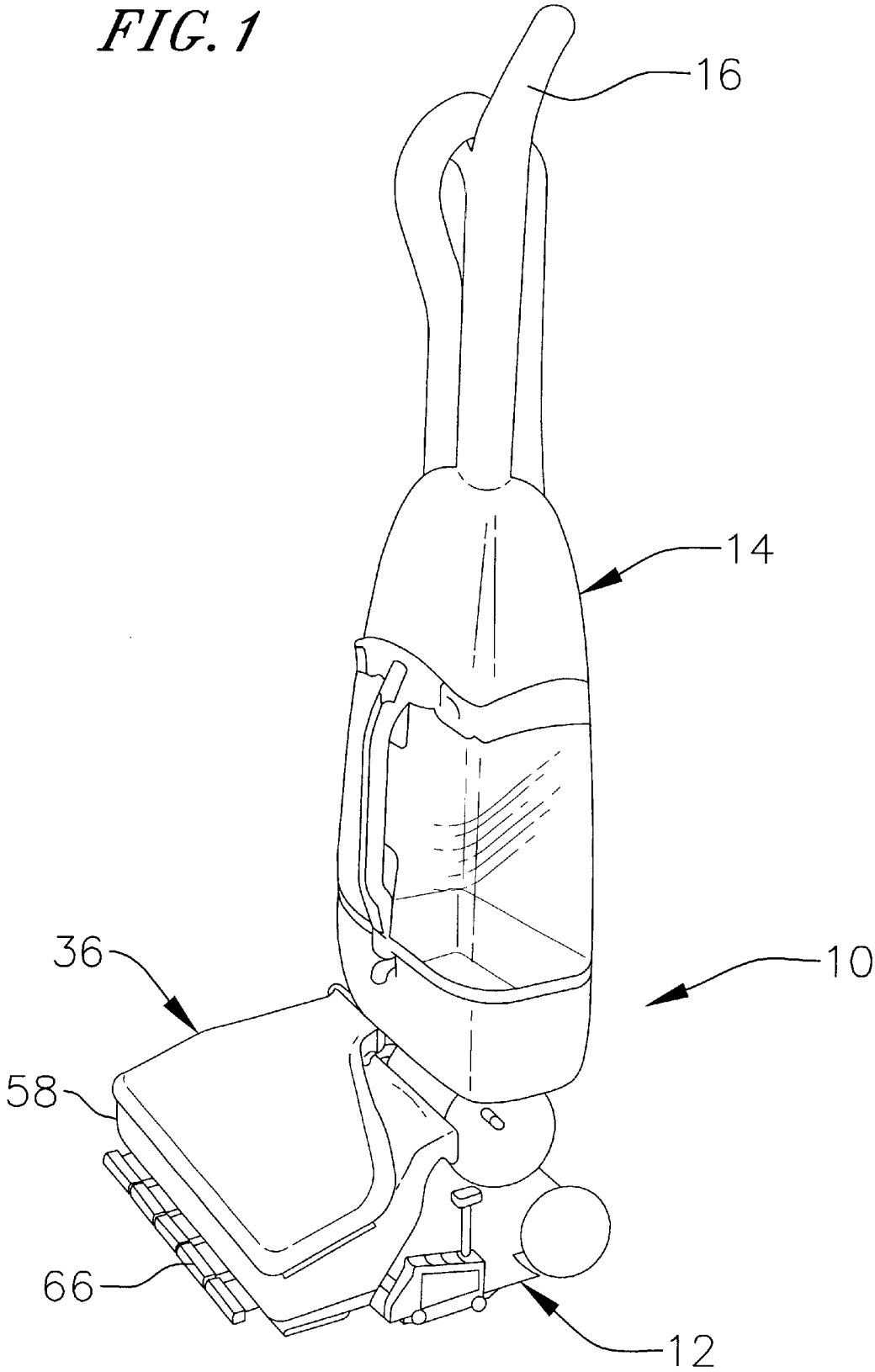
FIG. 1 is a front perspective view of a vacuum cleaner in accordance with a first embodiment of a present invention.

FIG. 1 perspectively illustrates a vacuum cleaner 10 constructed in accordance with a first preferred embodiment of the present invention. The vacuum cleaner 10 comprises a cleaning head portion 12 and an upright portion 14. The vacuum cleaner 10 is used by pushing the cleaning head portion 12 over the surface or floor covering to be cleaned with a handle 16 attached to the upright portion 14 thereof.

Figure 2:
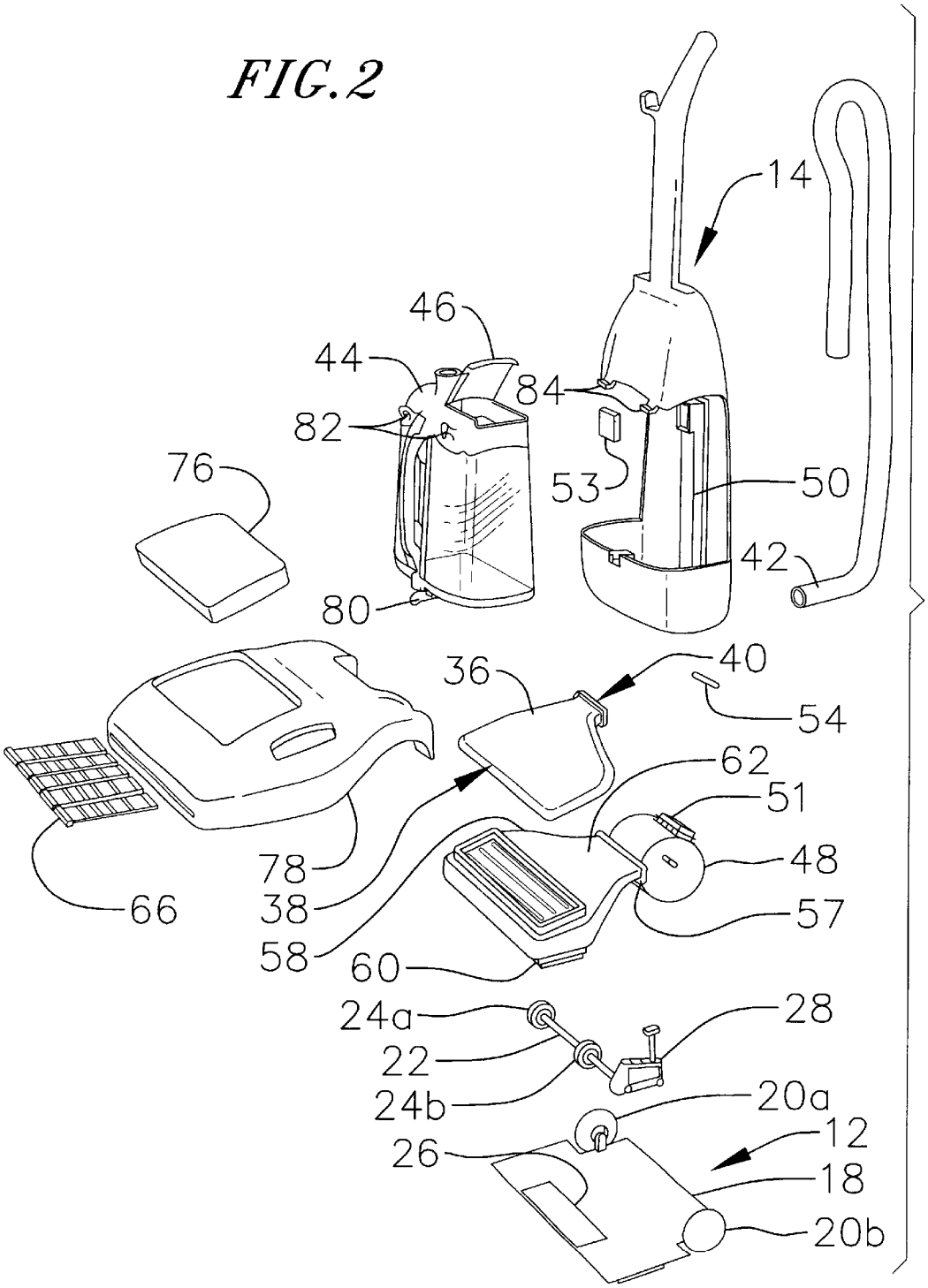
FIG. 2 is an exploded perspective view of the vacuum cleaner illustrated in FIG. 1.

Referring to FIG. 2, the cleaning head portion 12 has a generally rectangular floor plate 18 that supports a pair of rotatable rear wheels 20*a* and 20*b* placed at opposite corners of the floor plate 18. Also attached to the floor plate 18 is a front axle 22 supporting a pair of rotatable front wheels 24*a* and 24*b*. The axle 22 is attached to floor plate 18 in a position whereat each of the front wheels 24*a* and 24*b* protrude through an opening 26 formed within floor plate 18. The front wheels 24*a* and 24*b*, as well as rear wheels 20*a* and 20*b*, are configured to travel and support the floor plate 18 and cleaning head portion 12 above the floor covering. Additionally, the front axle 22 is attached to a vertical height adjustment mechanism 28 that is capable of selectively adjusting the height of the floor plate 18 above the floor covering. Specifically, the height adjustment mechanism 28 can change the vertical spacing between the floor plate 18 and the axle 22 in order to move the cleaning head portion 12 either closer to or further away from the floor covering.

Figure 3:
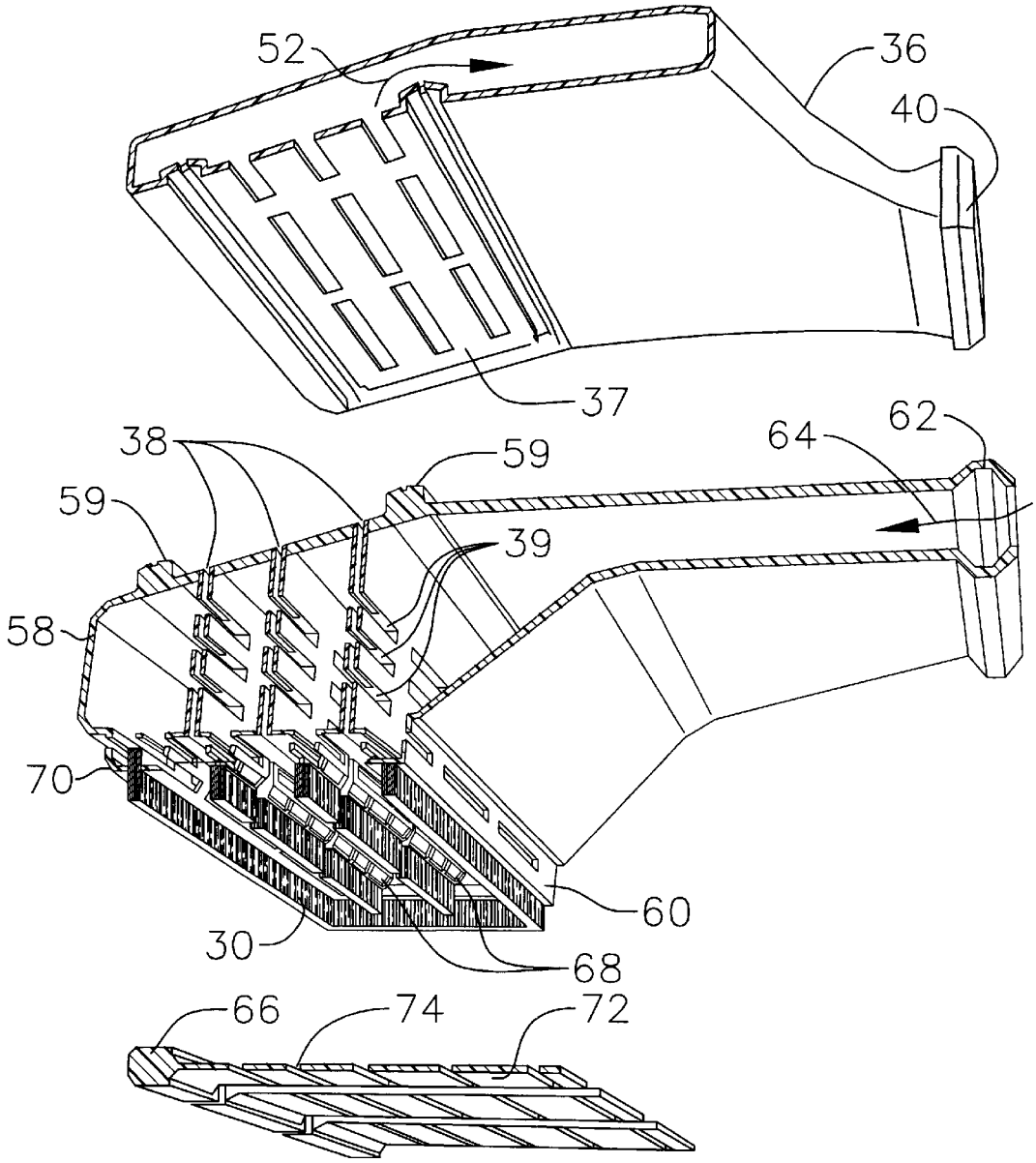
FIG. 3 is a sectional perspective view of the air inlet and defection channels of the vacuum cleaner illustrated in FIG. 1.
Figure 4A:
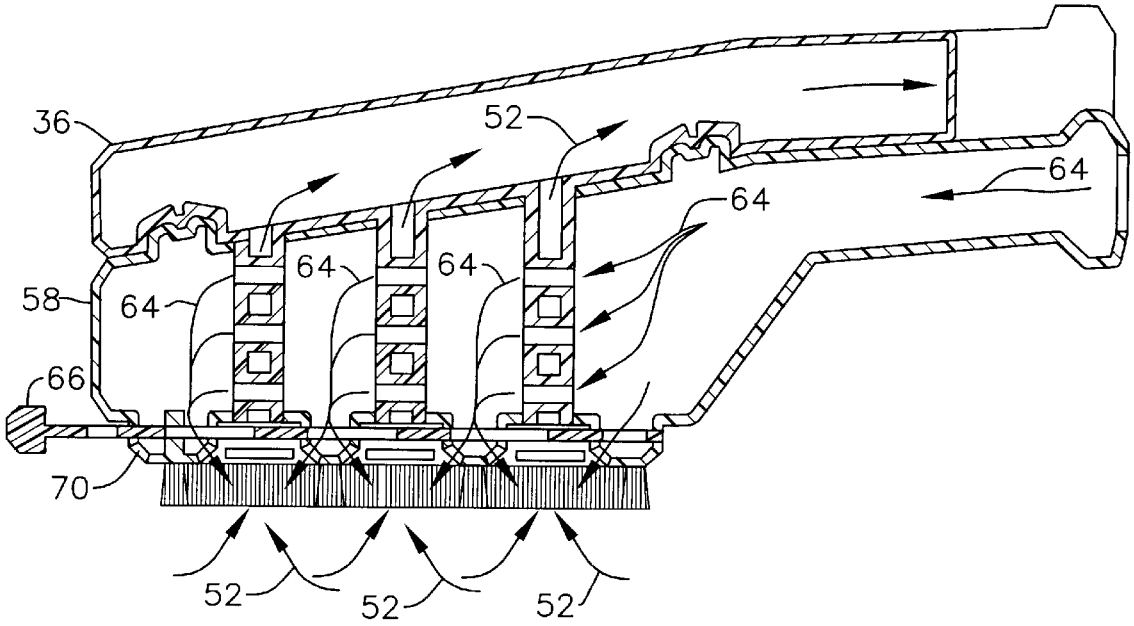
FIGS. 4A and 4B are sectional views of the inlet and deflection channels of the vacuum cleaner illustrated in FIG. 1.
Figure 4B:
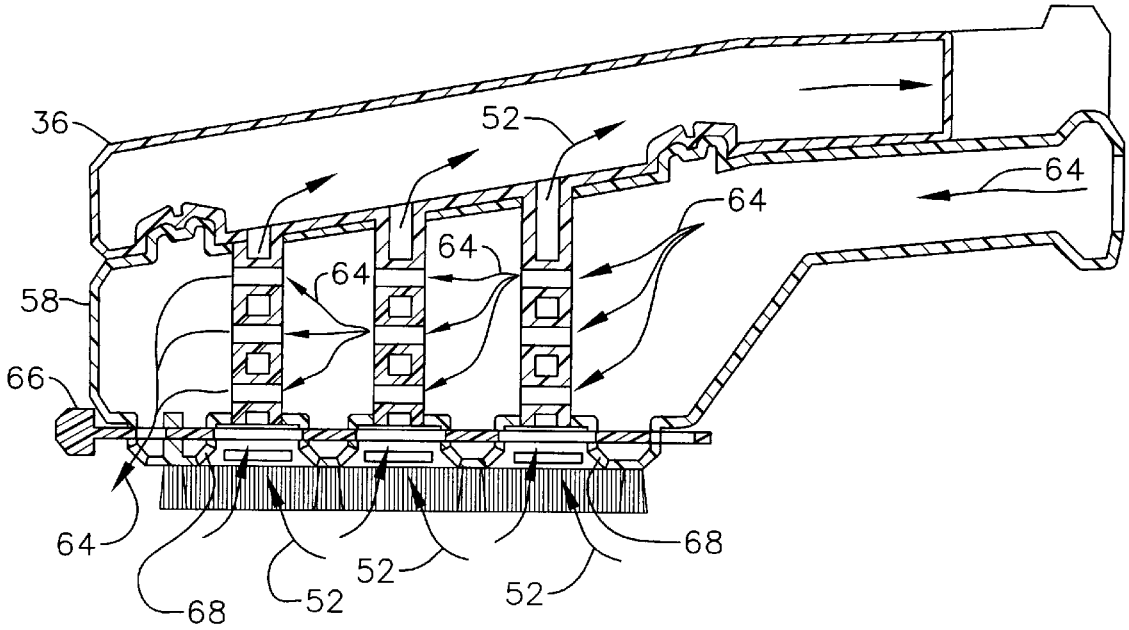

Referring to FIG. 3 and FIGS. 4*a* and 4*b*, disposed adjacent to the air inlet aperture extension 38 and the rearward air deflection channel 68 are rows of brushes 30, positioned such that they will further aid in the agitation process of the floor covering and will also serve to contain most of the output air stream 64 in the area directly under the air return outlet 58.

As seen in FIG. 3, the air inlet 36 has a generally hollow, bell shaped configuration whereby a lower portion thereof is shaped as an elongate rectangular base 37 with a plurality of openings adapted to be in fluid communication with the air inlet aperture extensions 38 which are disposed vertically through the air return outlet 58. The low pressure input stream 52 is maintained within the inlet aperture extensions 58 and the air inlet 36 by way of an air tight seal 59. Additionally, the upper portion is angled approximately ninety relative to the bottom portion, and tapers to an upper orifice 40 to be in fluid communication with a flexible hose 42.

In the first preferred embodiment of the present invention, the hose 42 is coupled between the inlet 36 and a top attachment point of an airtight dustbin 44. As seen in FIG. 2, the dustbin 44 is attachable to the upright portion 14 of vacuum cleaner 10 through the use of a spring clip 80, slots 82 and tabs 84. The tabs 84 of upright portion 14 are insertable into the slots 82 of dustbin 44 such that the dustbin 44 can be swung into place on upright portion 14. The spring clip 80 thereby frictionally secures the dustbin 44 to the upright portion 14. The dustbin 44 is an airtight container that uses a loose plastic mesh to collect debris that is drawn into the air inlet 36 and hose 42. The dustbin 44 includes a hinged lid 46 that is openable to provide access into the container for removal of dirt and debris when the dustbin 44 is removed from the upright portion 14.

In order to draw dirt and debris into the dustbin 44, the vacuum cleaner 10 is equipped with a blower or motor assembly 48 fluidly connected to the dustbin 44 through a duct 50. The duct 50 is formed within the upright portion 14 and fluidly connects the dustbin 44 to an intake 51 of the motor assembly 48. The motor assembly 48 contains a motor and rotating fan arrangement (not shown) that produces a low pressure input streams 52 of air as seen in FIGS. 4*a* and 4*b*. The low pressure input stream 52 draws dust and debris through the inlet 36 and hose 42 such that the dust and debris is deposited within the dustbin 44. In order to trap the dust within the dustbin 44, there is provided a first filter 53 disposed between the dustbin 44 and the duct 50. Additionally, a second filter 54 is disposed between the duct 50 and the intake 51 of motor assembly 48. The second filter B54 is located within a flexible coupling 55 that attaches intake 51 of the motor assembly 48 to the duct 50. The first 53 and second 54 filters prevent debris from entering and damaging the motor assembly 48 as well as the trap dust.

The motor assembly 48 produces an output stream 64 of air through an exhaust port 57 of motor assembly 48. The exhaust port 57 is fluidly connected to an air return outlet 58 that is a generally hollow, bell shaped housing that has a narrowed upper portion 62 angled approximately ninety degrees to a rectangular lower portion 60. The outlet 58 directs an output stream 64 of air past the inlet aperture extensions 38 by way of a plurality of inlet bypass channels 39 and then continues through either a plurality of rearward deflection channels 68 or a forward deflection channel 70, as seen in FIG. 3 and FIGS. 4*a* and 4*b*. In the first preferred embodiment of the present invention, the rearward deflection channels 68 are configured to direct the output streams 64 toward the floor covering directly beneath the air inlet aperture extensions 38 which occupy the spaces between the rows of rearward deflection channels 68. The output stream 64 can be deflected into either the forward deflection channel 70 or the plurality of rearward deflection channels 68, depending upon the position of a selector or slidable edge detection button 66. The edge detection button 66 has a closed portion 72 that blocks the output stream 64 from entering a respective channel and an open portion 74 that allows output stream 64 to enter a respective channel. Therefore, by laterally sliding the edge detection button 66 between the rear deflection channels 68 and forward deflection channel 70, the output stream 64 can be directed through a respective channel. In the first preferred embodiment of the present invention, the detection button 66 is positioned to allow the output stream 64 to exit through the rear deflection channels 68 during normal vacuuming. However, as seen in FIG. 4*b*, if the vacuum cleaner is pressed up against a wall, the edge detection button 66 will contact the wall and slide rearward thereby closing the rear deflection channels 68 and opening the forward detection channel 70. As such, the output stream 64 will be directed towards the front of the vacuum cleaner 10 to thereby blow out dirt and debris that has collected between the wall (or other obstacle) and the floor that can then be collected by the air inlet aperture extensions 38. Therefore, the vacuum cleaner 10 constructed in accordance with the present invention does not need special tools or attachments for cleaning the junction between the wall and the floor.

Since the vacuum cleaner 10 constructed in accordance with the first preferred embodiment of the present invention reuses the exhaust output stream 64, the motor in the motor assembly 48 may be sized appropriately. As will be recognized to those of ordinary skill in the art, the motor may be smaller and consume less energy than a conventional vacuum cleaner since it does not power a spinning agitator. Therefore, it is contemplated that the motor may be powered by a rechargeable battery 76 mounted within a hood 78. As seen in FIG. 2, the hood 78 covers the top of the cleaning head portion 12 when attached thereto. The battery 76 is attached to the top of the hood 78 for easy recharging and ideal weight distribution. If the vacuum cleaner 10 is used with a battery 76, then the battery 76 will be designed to operate at 12 volts, 7 amp/hours for the duration of at least 1 hour in order to sustain the motor with 120 volts at 6 amps and spinning at 25,000 RPM.

Figure 5:
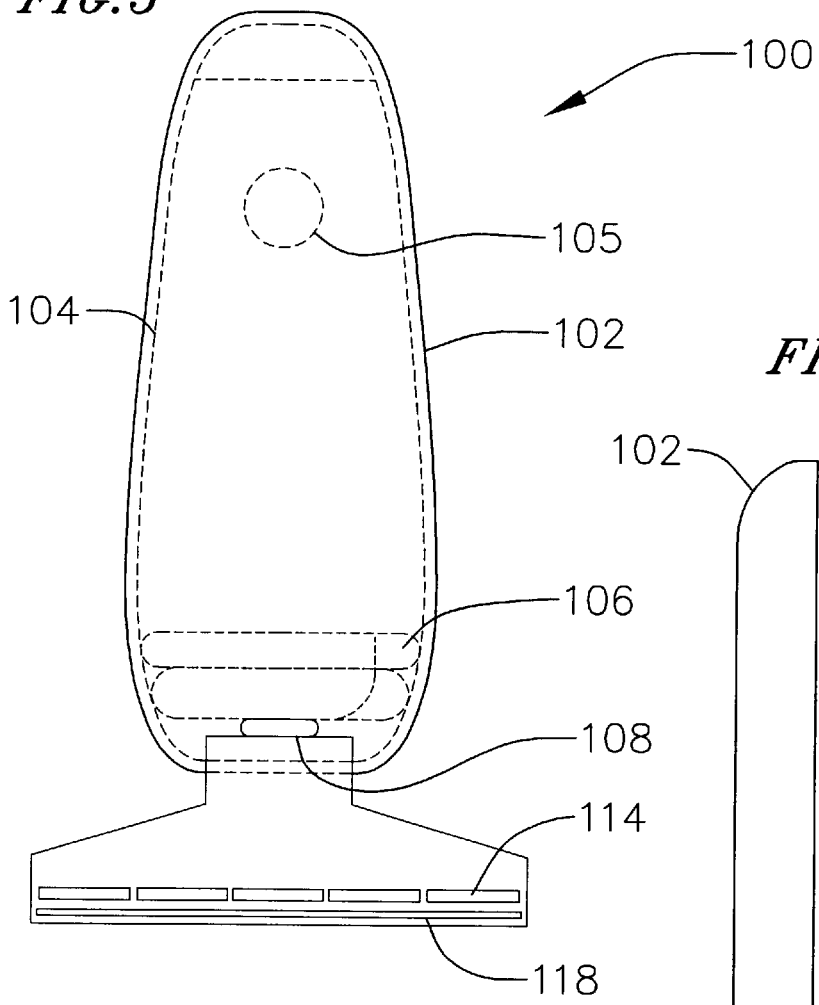
FIG. 5 is a front view of a vacuum cleaner attachment in accordance with the first embodiment of a present invention.
Figure 6:
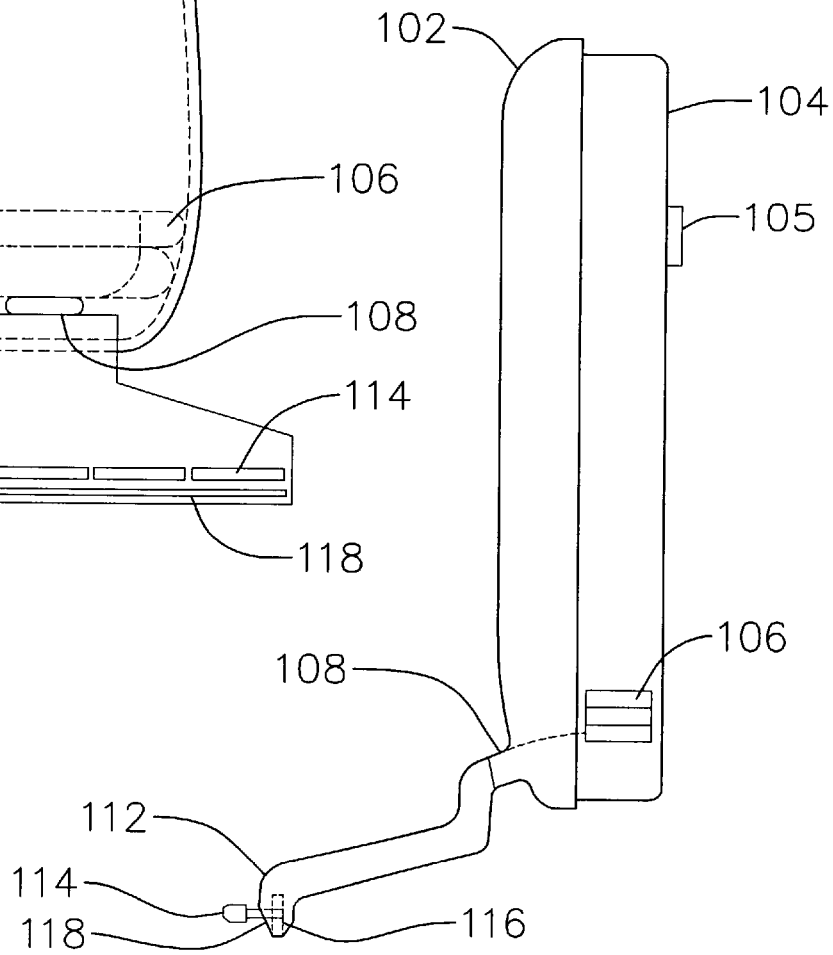
FIG. 6 is a side view of the vacuum cleaner attachment illustrated in FIG. 5.
Figure 7:
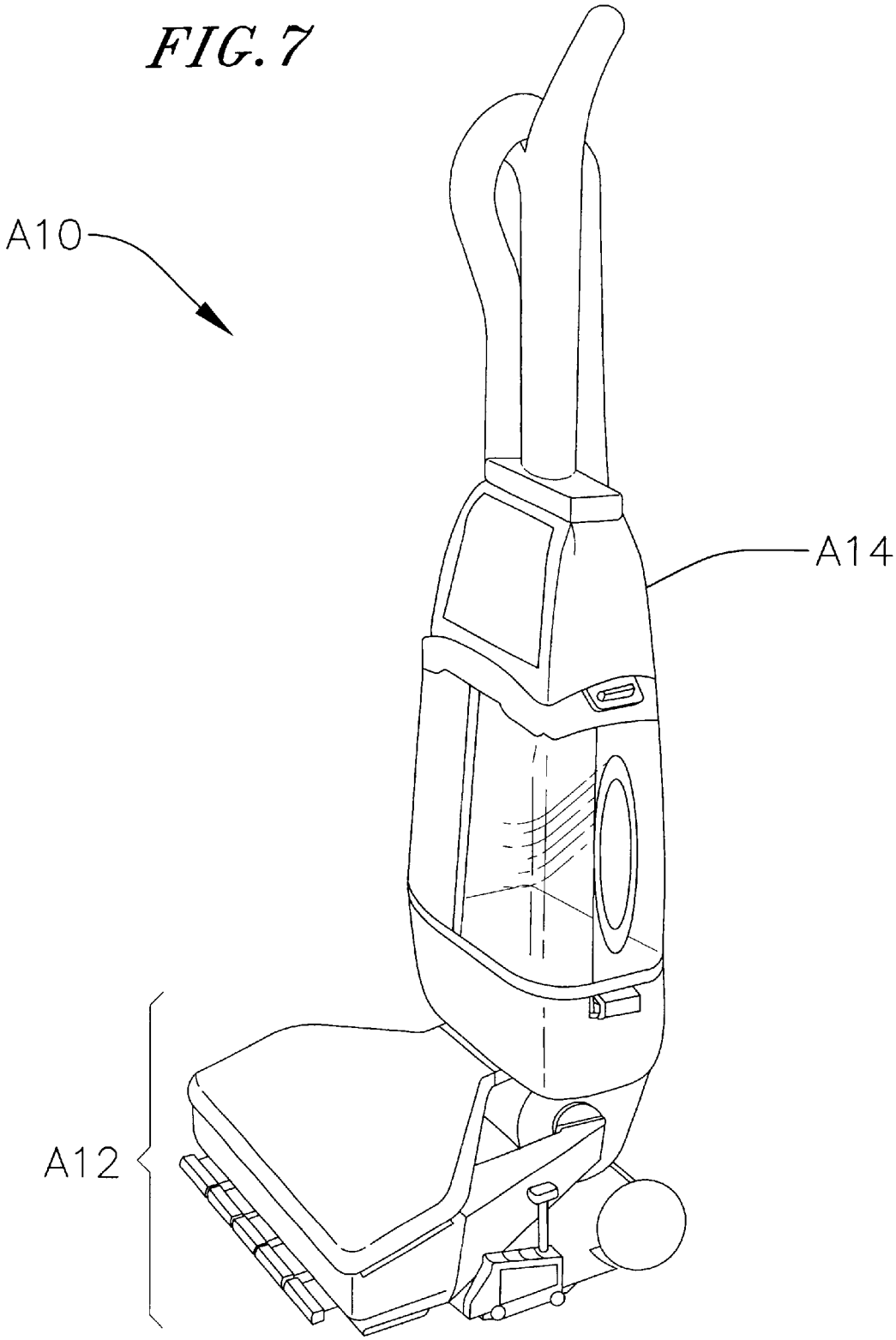
FIG. 7 is a perspective view of a vacuum cleaner in accordance with a second embodiment of a present invention.

Referring to FIG. 5 and FIG. 6, the vacuum cleaner 10 of the present invention is also provided an air return accessory 100 for attachment to an existing vacuum cleaner. The air return accessory 100 comprises a front housing 102 that is attachable to the upright portion of an existing vacuum cleaner such as an Eureka World VAC. Specifically, the front housing 102 replaces the existing upright body cover and disposable bag of the vacuum cleaner. The front housing 102 snaps into the upright portion using a standard spring loaded handle/clip apparatus (not shown). The front housing 102 contains an airtight accessory dustbin 104 that is coupled to the inlet of the existing vacuum cleaner through adaptive orifice 105. The input air flows through the dustbin 104 and is filtered by an accessory filter 106 before exiting the dustbin 104 through accessory exhaust opening 108. An accessory outlet 110 is coupled to the accessory exhaust 108 in order to direct the exhaust toward the existing air inlet of the vacuum cleaner. The accessory outlet 110 has a forward lip 112 that projects downwardly in front of the air inlet of the existing vacuum cleaner. Additionally, the accessory outlet 110 is configured with an accessory edge detection button 114 that directs the output stream either forward or rearward. The accessory outlet 110 and accessory edge detection button 114 operate identically to the edge detection button 66 and outlet 58 of the vacuum 10. The accessory edge detection button 144 will direct the exhaust stream rearward through an accessory rear channel 116 during normal operation and forward through an accessory forward channel 118 when the accessory outlet 110 is in contact with a wall or obstruction and the accessory edge detection button 114 is depressed. When the accessory dustbin 104 has been filled with dust and debris, it may be emptied through a hinged lid (not shown).

Referring to FIGS. 7 to 11, a second preferred embodiment of the present invention is illustrated. The vacuum cleaner A10 of the second embodiment is a modified mode of the above first preferred embodiment that basically constructs as the above first embodiment to comprise a cleaning head A12 and an upright portion A14. The vacuum cleaner A10 of the present invention is used by pushing the cleaning head portion A12 over the surface of floor covering to be cleaned with a handle A16 attached to the upright portion A14 thereof.

Figure 8:
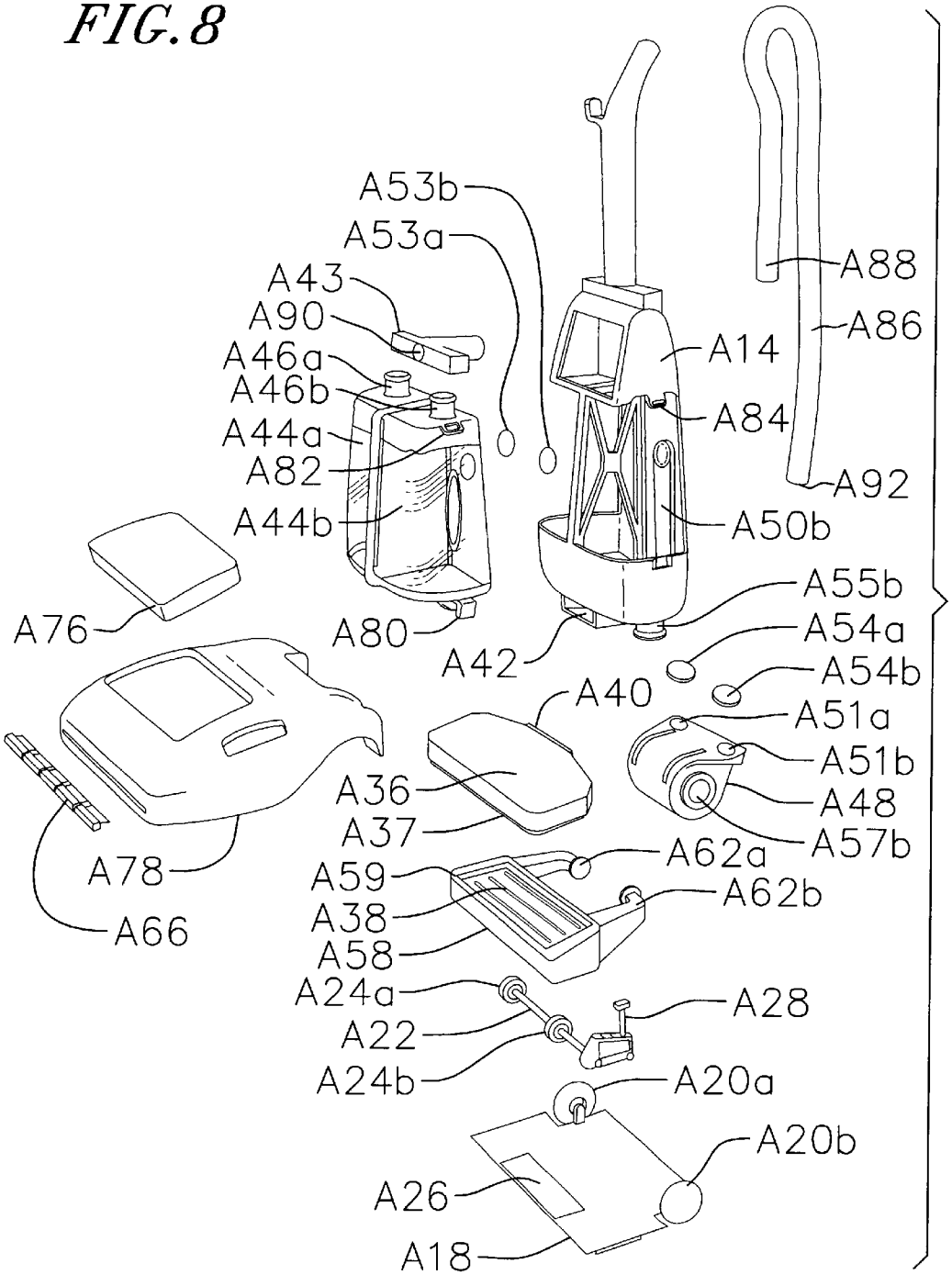
FIG. 8 is an exploded perspective view of the vacuum cleaner illustrated in FIG. 7.

Referring to FIG. 8, similar to the above first embodiment, the cleaning head portion A12 has a generally rectangular floor plate A18 that supports a pair of rotatable rear wheels A20*a* and A20*b* placed at opposite corners of the floor plate A18. Also attached to the floor plate A18 is a front axle A22 supporting a pair of rotatable front wheel A24*a* and A24*b*. The axle A22 is attached to floor plate A18 in a position whereat each of the front wheels A24*a* and A24*b* protrude through an opening A26 formed within the floor plate A18. The front wheels A24*a* and A24*b*, as well as rear wheels A20*a* and A20*b*, are configured to travel and support the floor plate A18 and cleaning head portion A12 above the floor covering. Additionally, the front axle A22 is attached to a vertical height adjustment mechanism A28 that is capable of selectively adjusting the height of the floor plate A18 above the flooring covering. Specifically, the height adjustment mechanism A28 can change the vertical spacing between the floor plate A18 and the axle A22 in order to move the cleaning head portion A12 either closer to or further away from the floor covering.

Referring to FIGS. 8 to 11, the major modifications of the second embodiment with respect to the above first embodiment is to provide a blower or motor assembly A48 containing a pair of intakes A51*a* and A51*b* disposed on two opposite sides and an air return outlet A58 having a pair of upper portions A62*a* and A62*b* which are connected to the two intakes A51*a* and A51*b* of the motor assembly A48.

Figure 9:
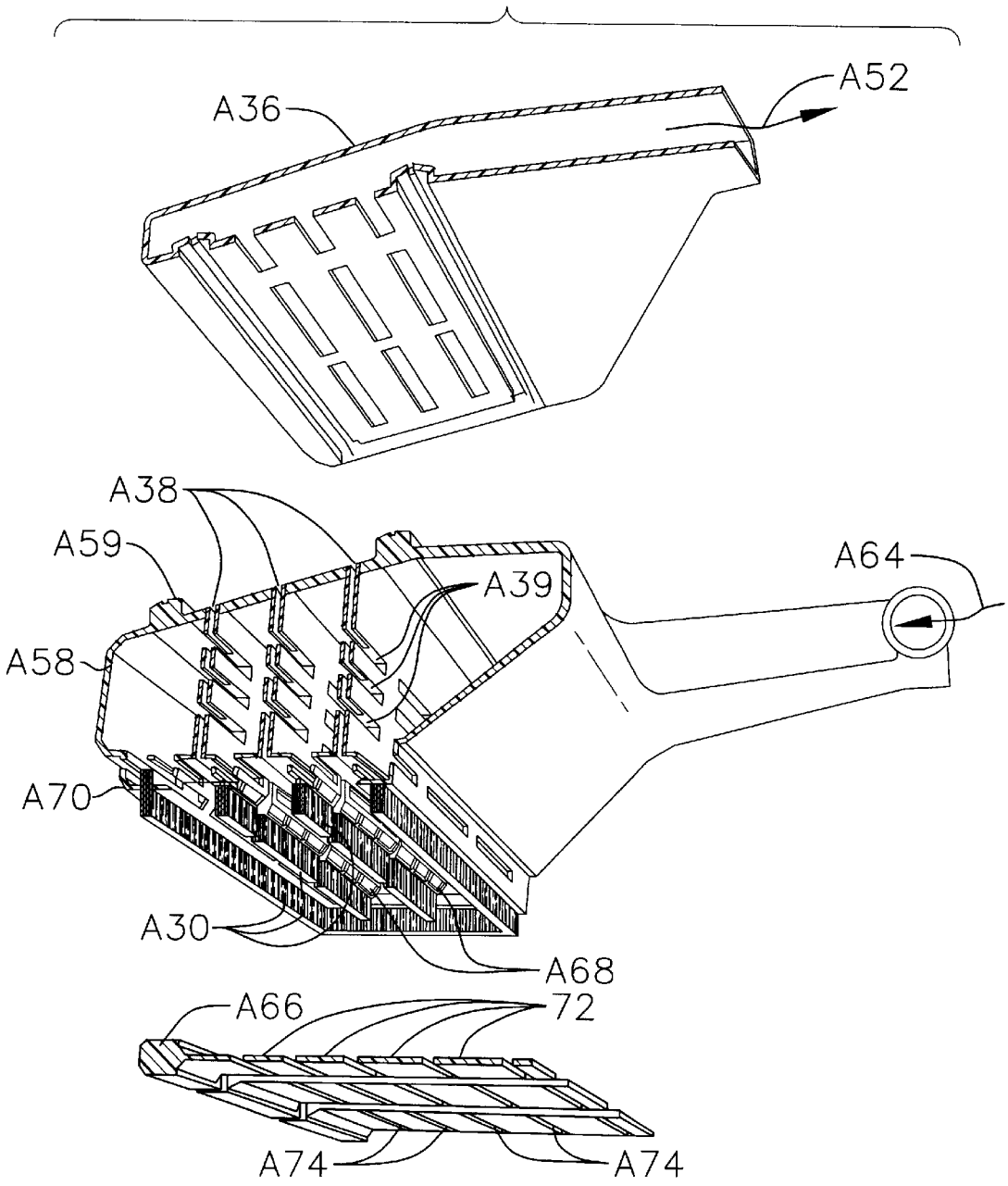
FIG. 9 is a sectional perspective view of the air inlet and defection channels of the vacuum cleaner illustrated in FIG. 7.

Referring to FIG. 8 and FIG. 9, disposed adjacent to the air inlet aperture extension A38 and the rearward air deflection channel A68 are rows of brushes A30, positioned such that they will further aid in the agitation process of the floor covering and will also serve to contain most of the output air stream A64 in the area directly under the air return outlet A58.

As seen in FIG. 8, the air inlet A36 has a generally hollow, bell shaped configuration whereby a lower portion thereof is shaped as an elongate rectangular base A37 with a plurality of openings adapted to be in fluid communication with the air inlet aperture extensions A38 which are disposed vertically through the air return outlet A58. The low pressure input stream A52 is maintained within the inlet aperture extensions A58 and the air inlet 36 by way of an air tight seal A59. Additionally, the upper portion is angled approximately ninety relative to the bottom portion, and tapers to an upper orifice A40 to be in fluid communication with an intake orifice A42 in the upright portion A14.

In the second preferred embodiment of the present invention, the intake orifice A42 is in fluid communication between the inlet A36 and a top attachment adapter A43 of one or two airtight dustbins A44*a* and A44*b*. As seen in FIG. 8, the dustbins A44*a* and A44*b* are attachable to the upright portion A14 of vacuum cleaner A10 through the use of a spring clip A80, slots A82 and tabs A84. The tabs A84 of upright portion A14 are insertable into the slots A82 of dustbins A44*a* and A44*b* such that the dustbins A44*a* and A44*b* can be swung into place on upright portion A14. The spring clip A80 thereby frictionally secures the dustbins A44*a* and A44*b* to the upright portion A14. The dustbins A44*a* and A44*b* are airtight containers that uses a loose plastic mesh (not shown) to collect debris that is drawn into the air inlet A36, intake orifice A42 and finally the dustbins A44*a* and A44*b*. The dustbins A44*a* and A44*b* include a hinged lids A46*a* and A46*b* that are openable to provide access into the container for removal of dirt and debris when the dustbins A44*a* and A44*b* is removed from the upright portion A14.

In order to draw dirt and debris into the dustbin A44, the vacuum cleaner A10 is equipped with a blower or motor assembly A48 fluidly connected to the dustbins A44*a* and A44*b* through ducts A50*a* (not shown) and A50*b*. The ducts A50*a* and A50*b* are formed within the base of the dustbins A44*a* and A44*b* and are fluidly connected to the intake A51*a* and A51*b* of the motor assembly A48.

Figure 10:
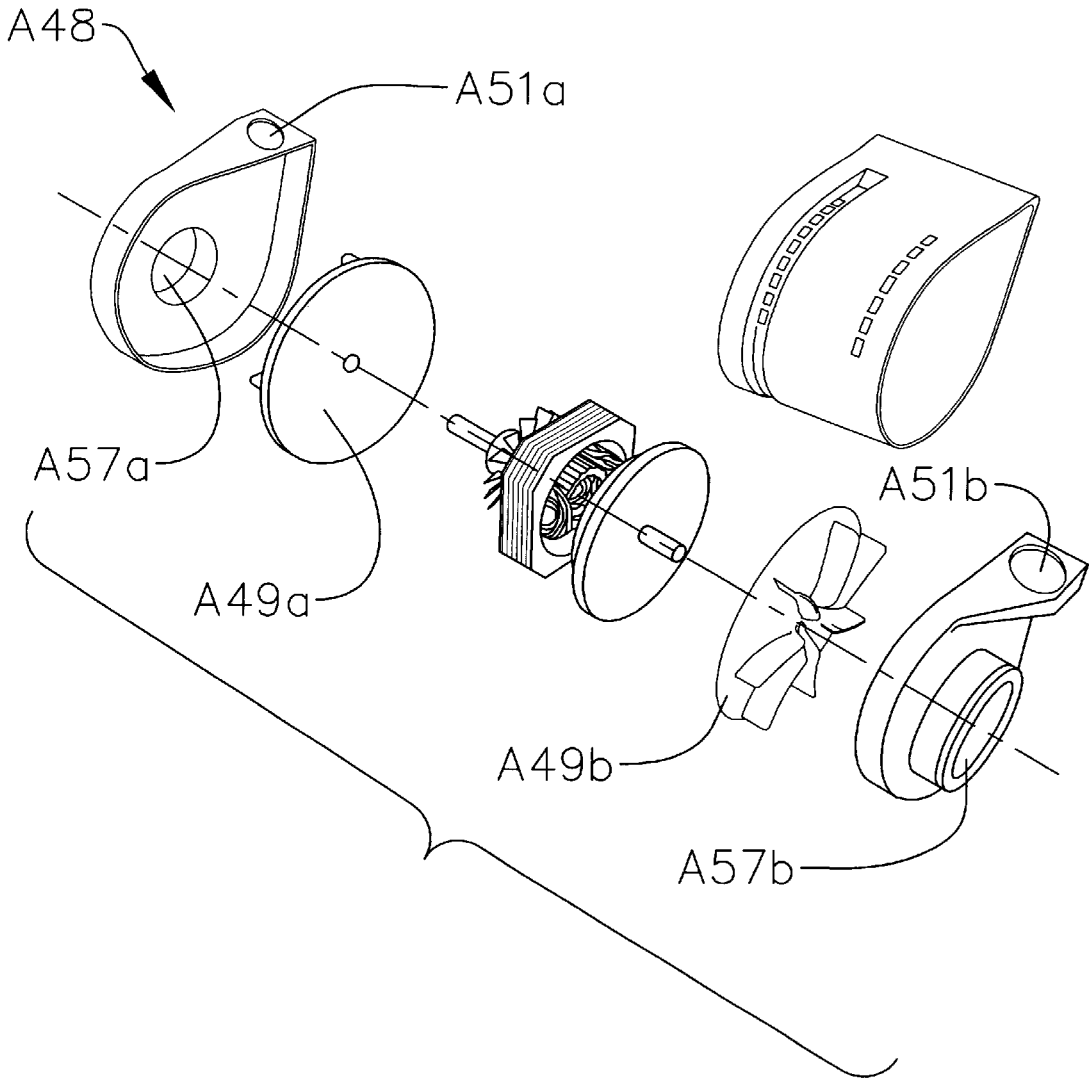
FIG. 10 is an exploded perspective view of the motor assembly of the vacuum cleaner illustrated in FIG. 7.

Referring to FIG. 10, the motor assembly A48 contains two fans A49*a* and A49*b* that rotate to produce a low pressure input streams A52 of air. The low pressure input stream A52 draws dust and debris through the inlet A36 and hose 42 such that the dust and debris is deposited within the dustbins A44*a* and A44*b*. In order to trap the dust within the dustbins A44*a* and A44*b*, filters A53*a* and A53*b* are disposed between the ducts A50*a* and A50*b* the dustbins A44*a* and A44*b* (respectively). Accordingly, the filters A54*a* and A54*b* are located within flexible couplings A55*a* (not shown) and A55*b* that attach intakes A51*a* and A51*b* of the motor assembly A48 to the ducts A50*a* and A50*b* (respectively). The first A53*a* and A53*b* and second A54*a* and A54*b* filters prevent debris from entering and damaging the motor assembly A48 as well as prevent dust from being expelled into the room.

The motor assembly A48 produces an output stream A64 of air through an exhaust port A57*a* and A57*b* of motor assembly A48. The exhaust ports A57*a* and A57*b* are fluidly connected to an air return outlet A58 that is a generally hollow, bell shaped housing that has a narrowed upper portions A62*a* and A62*b* angled approximately ninety degrees to a rectangular lower portion A60.

According to the second embodiment of the present invention, which similar to the first embodiment of the present invention as seen in FIG. 4*a* and FIG. 4*b*, the outlet A58 directs an output stream A64 of air past the inlet aperture extensions A38 by way of a plurality of inlet bypass channels A39 and then continues through either a plurality of rearward deflection channels A68 or a forward deflection channel A70. In the second preferred embodiment of the present invention, the rearward deflection channels A68 are configured to direct the output streams A64 toward the floor covering directly beneath the air inlet aperture extensions A38 which occupy the spaces between the rows of rearward deflection channels A68. The output stream A64 can be deflected into either the forward deflection channel A70 or the plurality of rearward deflection channels A68, depending upon the position of a selector or slidable edge detection button A66. The edge detection button A66 has a closed portion A72 that blocks the output stream A64 from entering a respective channel and an open portion A74 that allows output stream A64 to enter a respective channel. Therefore, by laterally sliding the edge detection button A66 between the rear deflection channels A68 and forward deflection channel A70, the output stream A64 can be directed through a respective channel. In the second preferred embodiment of the present invention, the detection button A66 is positioned to allow the output stream A64 to exit through the rear deflection channels A68 during normal vacuuming. However, if the vacuum cleaner is pressed up against a wall, the edge detection button A66 will contact the wall and slide rearward thereby closing the rear deflection channels A68 and opening the forward detection channel A70. As such, the output stream A64 will be directed towards the front of the vacuum cleaner A10 to thereby blow out dirt and debris that has collected between the wall (or other obstacle) and the floor that can then be collected by the air inlet aperture extensions A38. Therefore, the vacuum cleaner A10 constructed in accordance with the present invention does not need special tools or attachments for cleaning the junction between the wall and the floor.

Under circumstances where the use of an accessory extension would be the preferred method of vacuuming, a flexible hose A86 is provided with nozzle A88 which can be readily coupled to the top attachment adapter A43 by way of a nozzle orifice A90. The nozzle A88 is constructed such that when inserted into the nozzle orifice A90, fluid communication between the inlet A36 and the dustbins A44*a* and A44*b* is interrupted, thereby establishing fluid communication between a hose inlet A92 and the dustbins A44*a* and A44*b*.

Since the vacuum cleaner A10 constructed in accordance with the second preferred embodiment of the present invention reuses the exhaust output stream A64, the motor in the motor assembly A48 may be sized appropriately. As will be recognized to those of ordinary skill in the art, the motor may be smaller and consume less energy than a conventional vacuum cleaner since it does not power a spinning agitator. Therefore, it is contemplated that the motor may be powered by a rechargeable battery A76 mounted within a hood A78. As seen in FIG. 8, the hood A78 covers the top of the cleaning head portion A12 when attached thereto. The battery A76 is attached to the top of the hood A78 for easy recharging and ideal weight distribution. If the vacuum cleaner A10 is used with a battery 76, then the battery A76 will be designed to operate for a sufficient duration in order to sustain the motor with specifications of about 24 volts at 6 amps and spinning at 8,600 RPM.

Under circumstances where a cord powered vacuum is more desirable, the motor will be designed to operate indefinitely, sustaining usage of 120 volts at 6 amps and spinning at approximately 11,000 RPM.

Accordingly, the vacuum cleaner A10 of the second embodiment of the present invention is also provided an air return accessory A100 for attachment to an existing vacuum cleaner, as shown in FIGS. 5 and 6 with respect to the first embodiment of the present invention. The air return accessory A100 comprises a front housing A102 that is attachable to the upright portion of an existing vacuum cleaner such as an Eureka World VAC. Specifically, the front housing A102 replaces the existing upright body cover and disposable bag of the vacuum cleaner. The front housing A102 snaps into the upright portion using a standard spring loaded handle/clip apparatus (not shown). The front housing A102 contains an airtight accessory dustbin A104 that is coupled to the inlet of the existing vacuum cleaner through adaptive orifice A105. The input air flows through the dustbin A104 and is filtered by an accessory filter A106 before exiting the dustbin A104 through accessory exhaust opening A108. An accessory outlet A110 is coupled to the accessory exhaust A108 in order to direct the exhaust toward the existing air inlet of the vacuum cleaner. The accessory outlet A110 has a forward lip A112 that projects downwardly in front of the air inlet of the existing vacuum cleaner. Additionally, the accessory outlet A110 is configured with an accessory edge detection button A114 that directs the output stream either forward or rearward. The accessory outlet A110 and accessory edge detection button A114 operate identically to the edge detection button A66 and outlet A58 of the vacuum A10. The accessory edge detection button A144 will direct the exhaust stream rearward through an accessory rear channel A116 during normal operation and forward through an accessory forward channel A118 when the accessory outlet A110 is in contact with a wall or obstruction and the accessory edge detection button A114 is depressed. When the accessory dustbin A104 has been filled with dust and debris, it may be emptied through a hinged lid (not shown).

Referring to FIGS. 12 to 17, a vacuum cleaner B10 according to a third embodiment of the present invention is illustrated. The vacuum cleaner B10 comprises an agitator B30, which is disposed within an opening B26 and adjacent to front wheels B24*a* and B24*b*, having a first row of brushes B32*a* and a second row of brushes B32*b* disposed on the exterior surface of the agitator B30.

Figure 12:
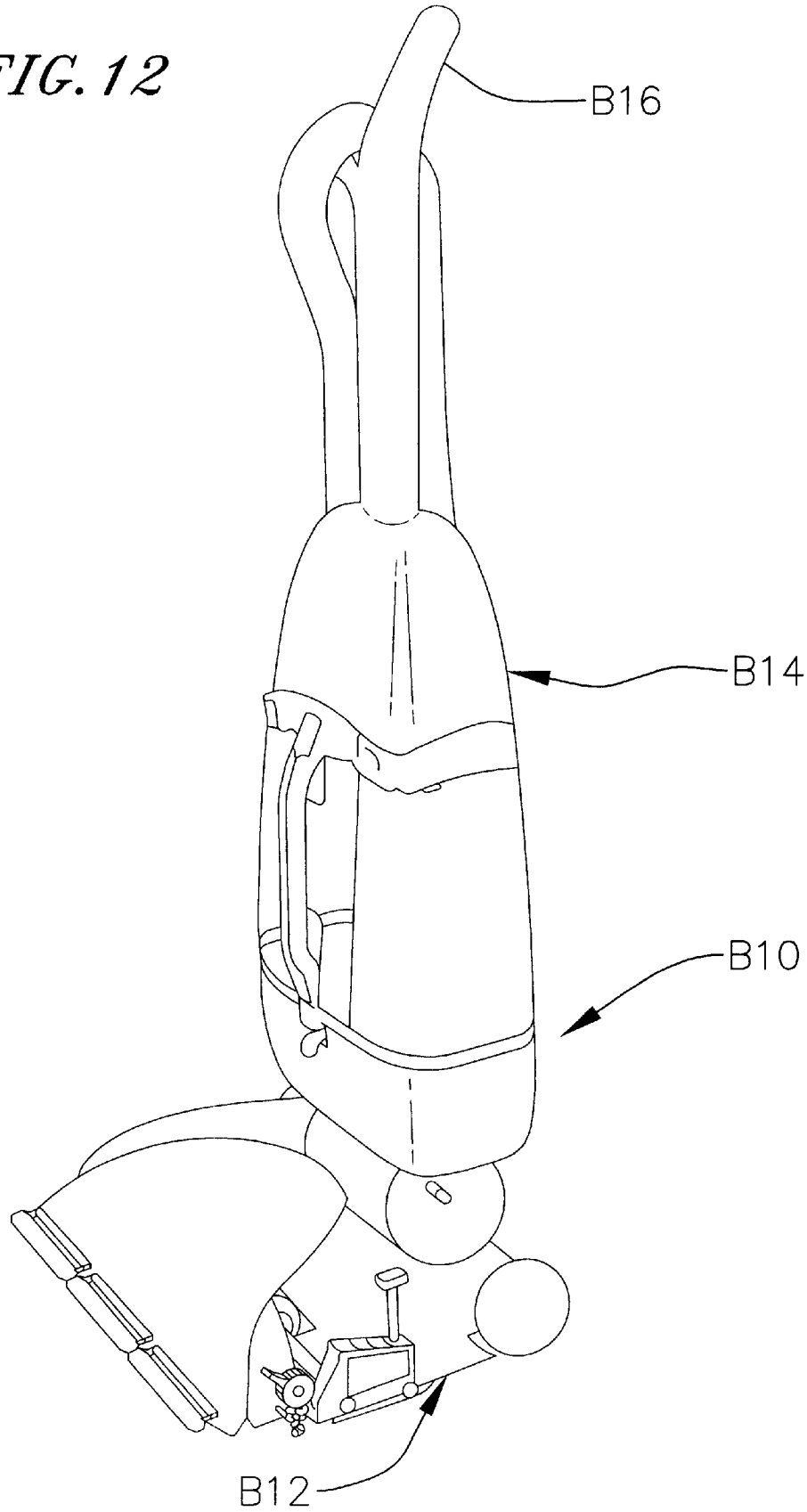
FIG. 12 is a perspective view of a vacuum cleaner in accordance with a third embodiment of a present invention.

Referring to the drawings wherein the showings are for purpose of illustrating the third preferred embodiment of the present invention only, and not for purpose of limiting the same, FIG. 12 perspectively illustrates a vacuum cleaner B10 constructed in accordance with the present invention. The vacuum cleaner B10 comprises a cleaning head portion B12 and an upright portion B14. The vacuum cleaner B10 of the present invention is used by pushing the cleaning head portion B12 over the surface or floor covering to be cleaned with a handle B16 attached to the upright portion B14 thereof.

Figure 13:
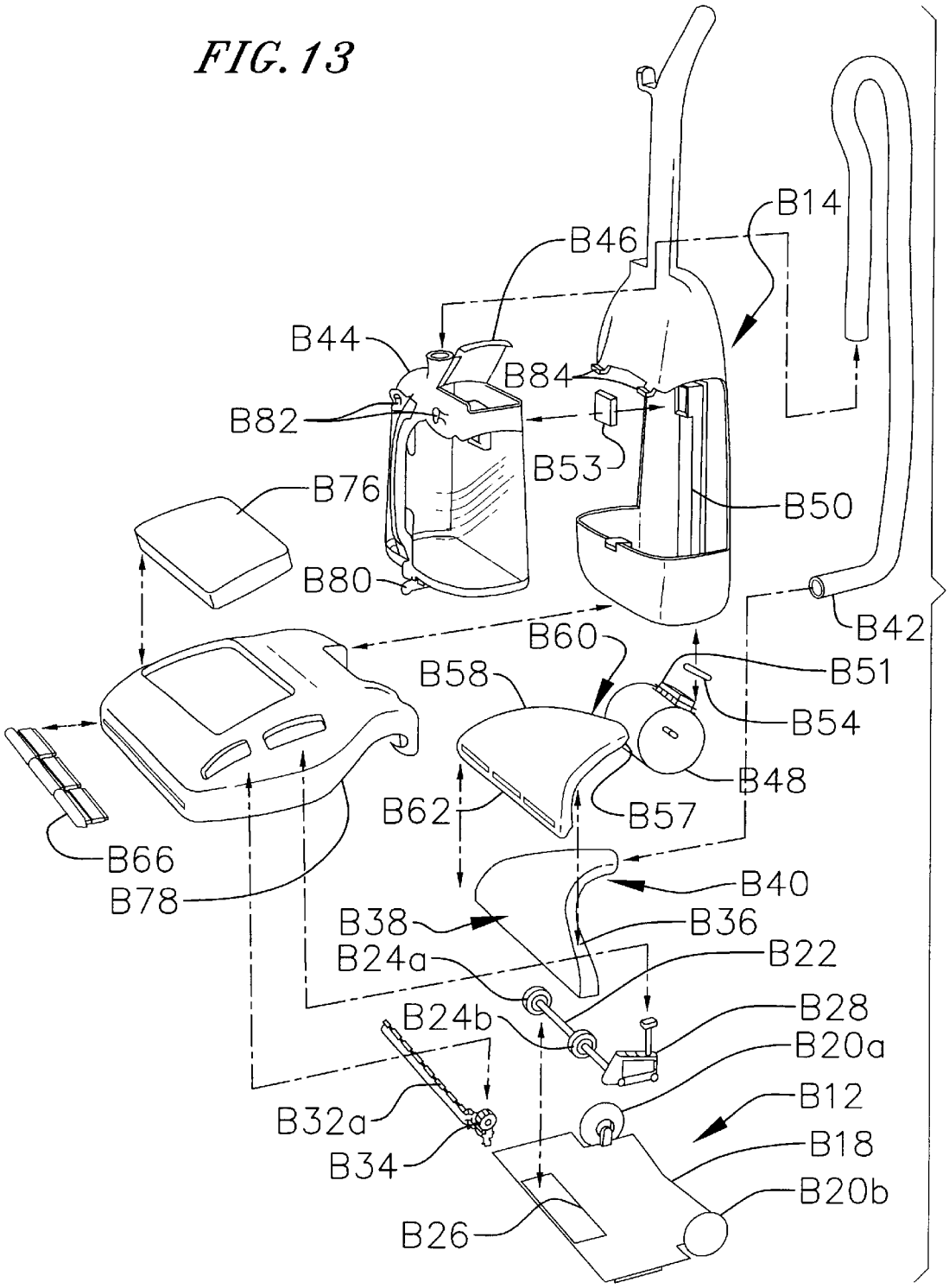
FIG. 13 is an exploded perspective view of the vacuum cleaner illustrated in FIG. 12.

Referring to FIG. 13, the cleaning head portion B12 has a generally rectangular floor plate B18 that supports a pair of rotatable rear wheels B20*a* and B20*b* placed at opposite corners of the floor plate B18. Also attached to the floor plate B18 is a front axle B22 supporting a pair of rotatable front wheels B24*a* and B24*b*. The axle 22 is attached to floor plate 18 in a position whereat each of the front wheels B24*a* and B24*b* protrude through an opening B26 formed within floor plate B18. The front wheels B24*a* and B24*b*, as well as rear wheels B20*a* and B20*b*, are configured to travel and support the floor plate B18 and cleaning head portion B12 above the floor covering. Additionally, the front axle B22 is attached to a vertical height adjustment mechanism B28 that is capable of selectively adjusting the height of the floor plate B18 above the floor covering. Specifically, the height adjustment mechanism B28 can change the vertical spacing between the floor plate B18 and the axle B22 in order to move the cleaning head portion B12 either closer to or further away from the floor covering.

Figure 14:
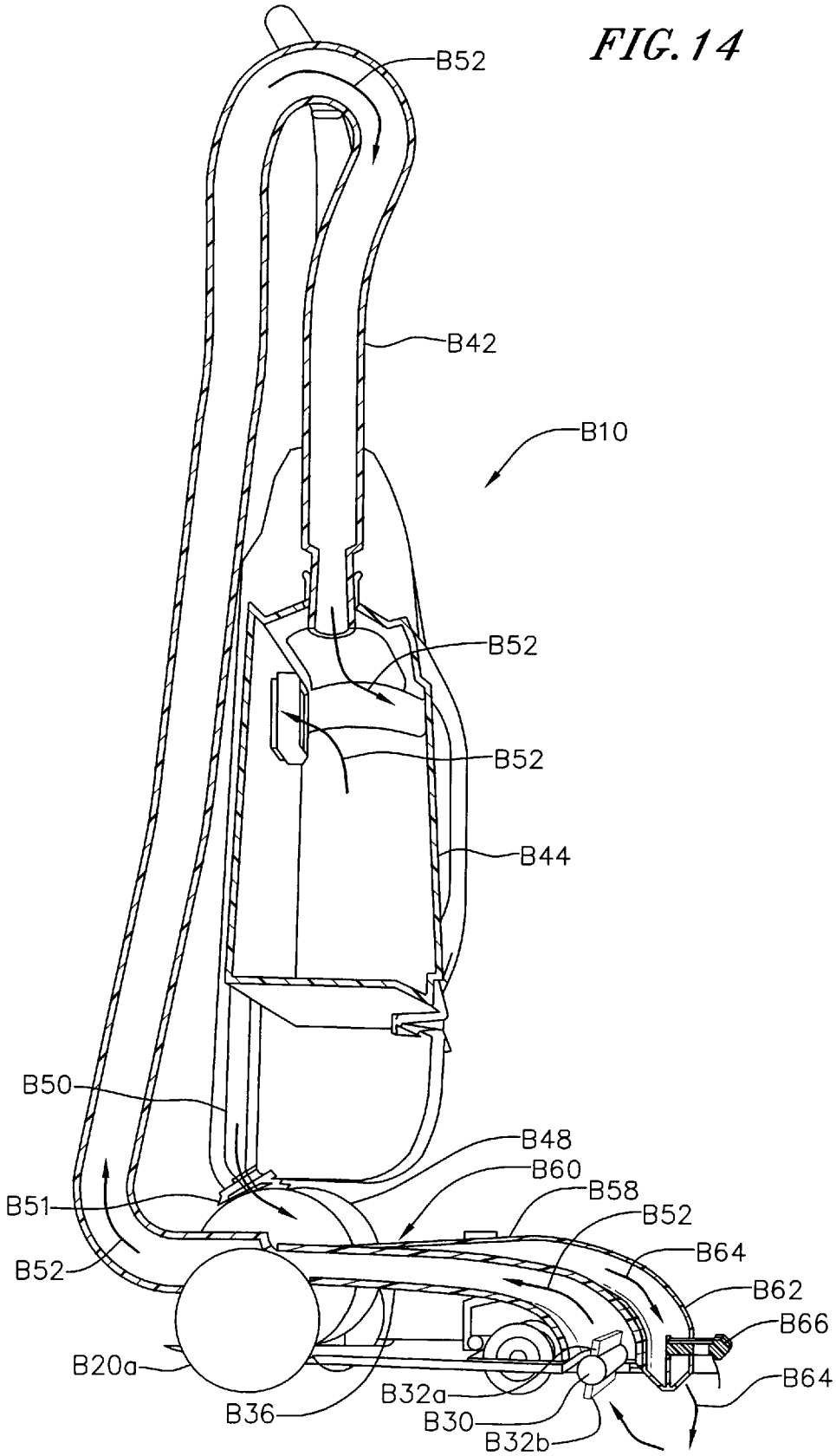
FIG. 14 is a sectional side view of the vacuum cleaner illustrated in FIG. 12.

Disposed within opening 26 and adjacent to front wheels B24*a* and B24*b* is an agitator B30. As seen in FIG. 14, the agitator B30 is an elongate tube with a first row of brushes B32*a* and a second row of brushes B32*b* disposed on the exterior surface thereof. The first row of brushes B32*a* are attached in opposite relation (i.e., about 180 degrees) to the second row of brushes B32*b* along the exterior of the agitator B30. The first row of brushes B32*a* may be series of firm brushes to be used on thick, shag carpeting and the second row of brushes may be soft brushes to be used on delicate floors. The agitator B30 does not rotate as in a conventional vacuum cleaner. Specifically, the first or second row of brushes B32*a*, are selected with brush selector lever B34 to comb the floor to be cleaned. The brush selector lever B34 selectively positions the agitator B30 between a first position whereat the first row of brushes B32*a* are in contact with the floor and a second position whereat the second row of brushes B32*b* are in contact with the floor. Additionally, the agitator B30 is coupled to the vertical height adjustment mechanism B28 so that the agitator B30 is at the same height above the floor covering as the front wheels B24*a* and B24*b*.

In order to draw dust and debris into the vacuum cleaner B10, an air inlet B36 is attached to the floor plate B18. As seen in FIGS. 13 and 14, the air inlet B36 is in fluid communication with the opening B26 such that dirt and debris may be drawn through opening B26 and into inlet B36. The inlet B36 is disposed over the agitator B30 such that dirt and/or debris disturbed by agitator B30 is immediately drawn into the inlet B36. As seen in FIG. 2, the air inlet B36 has a generally hollow, bell shaped configuration whereby a lower portion B38 thereof is shaped as an elongate rectangular opening that tapers into a narrow cylindrical upper portion B40. Additionally, the upper portion B40 is angled approximately ninety degrees relative to the bottom portion to facilitate connection to a flexible hose B42.

In the third preferred embodiment of the present invention, the hose B42 is coupled between the inlet B36 and a top attachment point of an airtight dustbin B44. As seen in FIG. 13, the dustbin B44 is attachable to the upright portion B14 of vacuum cleaner B10 through the use of a spring clip B80, slots B82 and tabs B84. The tabs B84 of upright portion B14 are insertable into the slots B82 of dustbin B44 such that the dustbin B44 can be swung into place on upright portion B14. The spring clip B80 thereby frictionally secures the dustbin B44 to the upright portion B14. The dustbin B44 is an airtight container that uses a loose plastic mesh to collect debris that is drawn into the air inlet B36 and hose B42. The dustbin B44 includes a hinged lid B46 that is openable to provide access into the container for removal of dirt and debris when the dustbin B44 is removed from the upright portion B14.

In order to draw dirt and debris into the dustbin B44, the vacuum cleaner B10 is equipped with a blower or motor assembly B48 fluidly connected to the dustbin B44 through a duct B50. The duct B50 is formed within the upright portion B14 and fluidly connects the dustbin B44 to an intake B51 of the motor assembly B48. The motor assembly B48 contains a motor and a rotating fan (not shown) that produces a low pressure input streams B52 of air seen in FIG. 14. The low pressure input stream B52 draws dust and debris through the inlet B36 and hose B42 such that the dust and debris is deposited within the dustbin B44. In order to trap the dust within the dustbin B44, there is provided a first filter B53 disposed between the dustbin B44 and the duct B50. Additionally, a second filter B54 is disposed between the duct B50 and the intake B51 of motor assembly B48. The second filter B54 is located within a flexible coupling B55 that attaches intake B51 of the motor assembly B48 to the duct B50. The first B53 and second B54 filters prevent debris from entering and damaging the motor assembly B48 as well as the trap dust.

Figure 15A:
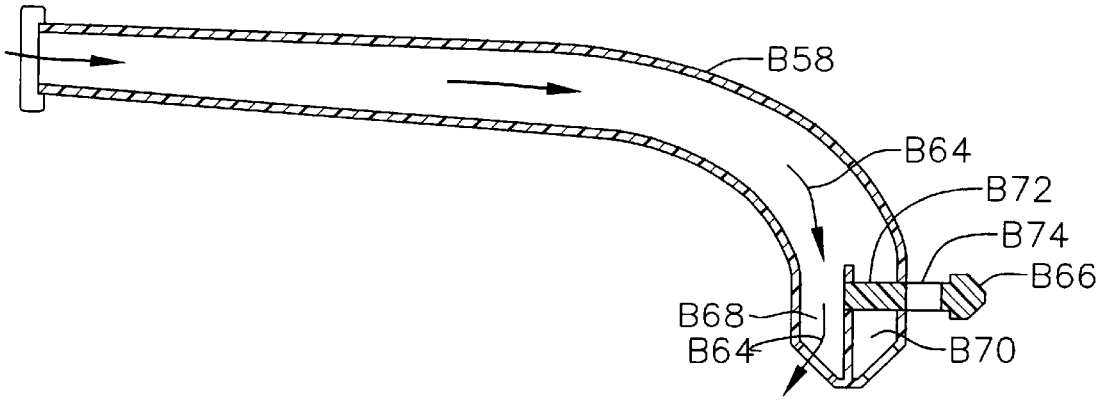
FIGS. 15A and 15B are sectional side views of the outlet for the vacuum cleaner illustrated in FIG. 12.
Figure 15B:
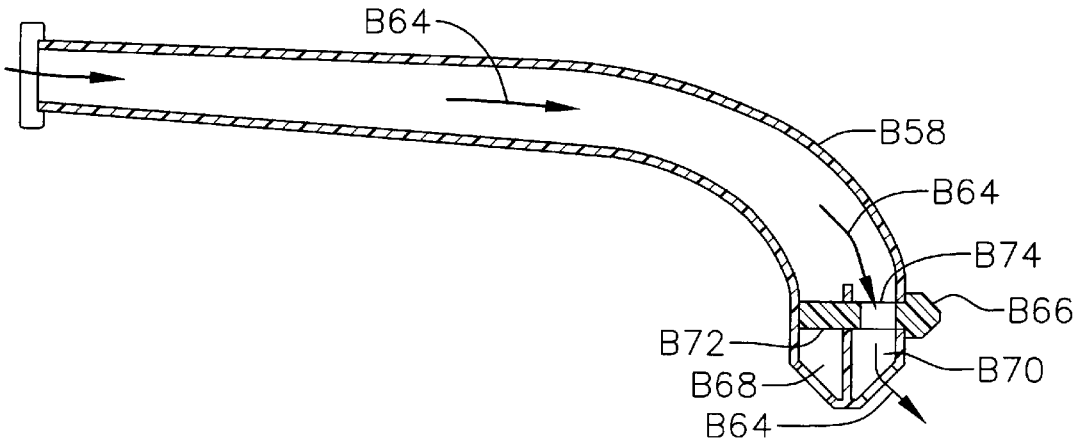

The motor assembly B48 produces an output stream B64 of air through an exhaust port B57 of motor assembly B48. The exhaust port B57 is fluidly connected to an air return outlet B58 that is a generally hollow, bell shaped housing that has a narrowed upper portion B60 angled approximately ninety degrees to a rectangular lower portion B62. The outlet B58 directs an output stream B64 of air adjacent to and in front of the input stream B52, as seen in FIG. 14. The outlet B58 is configured to direct the output stream B64 towards the inlet B36 during normal operation. As seen in FIG. 15A, the outlet B58 has a rear deflection channel B68 and a forward deflection channel B70. The output stream B64 can be deflected into one of the two channels (i.e., rear deflection channel B68 or forward deflection channel B70) depending upon the position of a selector or slidable edge detection button B66. The edge detection button B66 has a closed portion B72 that blocks the output stream B64 from entering a respective channel and an open portion B74 that allows output stream B64 to enter a respective channel. Therefore, by laterally sliding the edge detection button B66 between the rear deflection channel B68 and forward deflection channel B70, the output stream B64 can be directed through a respective channel. In the preferred embodiment of the present invention, the detection button B66 is positioned to allow the output stream B64 to exit the rear deflection channel B68 during normal vacuuming. However, as seen in FIG. 15*b*, if the vacuum cleaner is pressed up against a wall, the edge detection button B66 will contact the wall and slide rearward thereby closing the rear deflection channel B68 and opening the forward detection channel B70. As such, the output stream B64 will be directed towards the front of the vacuum cleaner B10 to thereby blow out dirt and debris that has collected between the wall and the floor that can then be collected by inlet B36. Therefore, the vacuum cleaner B10 constructed in accordance with the present invention does not need special tools or attachments for cleaning the junction between the wall and the floor.

Since the vacuum cleaner B10 constructed in accordance with the preferred embodiment of the present invention reuses the exhaust output stream B64, the motor in the motor assembly B48 may be sized appropriately. As will be recognized to those of ordinary skill in the art, the motor may be smaller and consume less energy than a conventional vacuum cleaner since it does not power a spinning agitator. Therefore, it is contemplated that the motor may be powered by a rechargeable battery B76 mounted within a hood B78. As seen in FIG. 13, the hood B78 covers the top of the cleaning head portion B12 when attached thereto. The battery B76 is attached to the top of the hood B78 for easy recharging. If the vacuum cleaner B10 is used with a battery B76, then the battery B76 will be designed to operate at 12 volts, 7 amp/hours for the duration of at least 1 hour in order to sustain the motor with 120 volts at 6 amps and spinning at 25,000 RPM.

Figure 16:
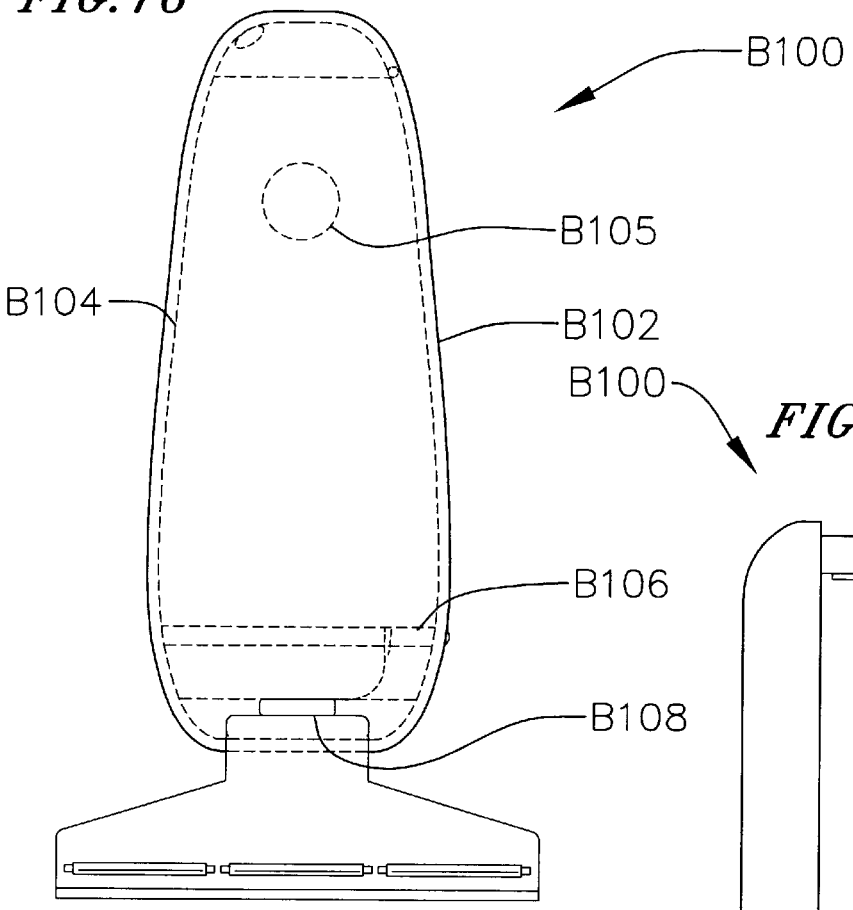
FIG. 16 is a front view of a vacuum cleaner attachment in accordance with the third embodiment of a present invention.
Figure 17:
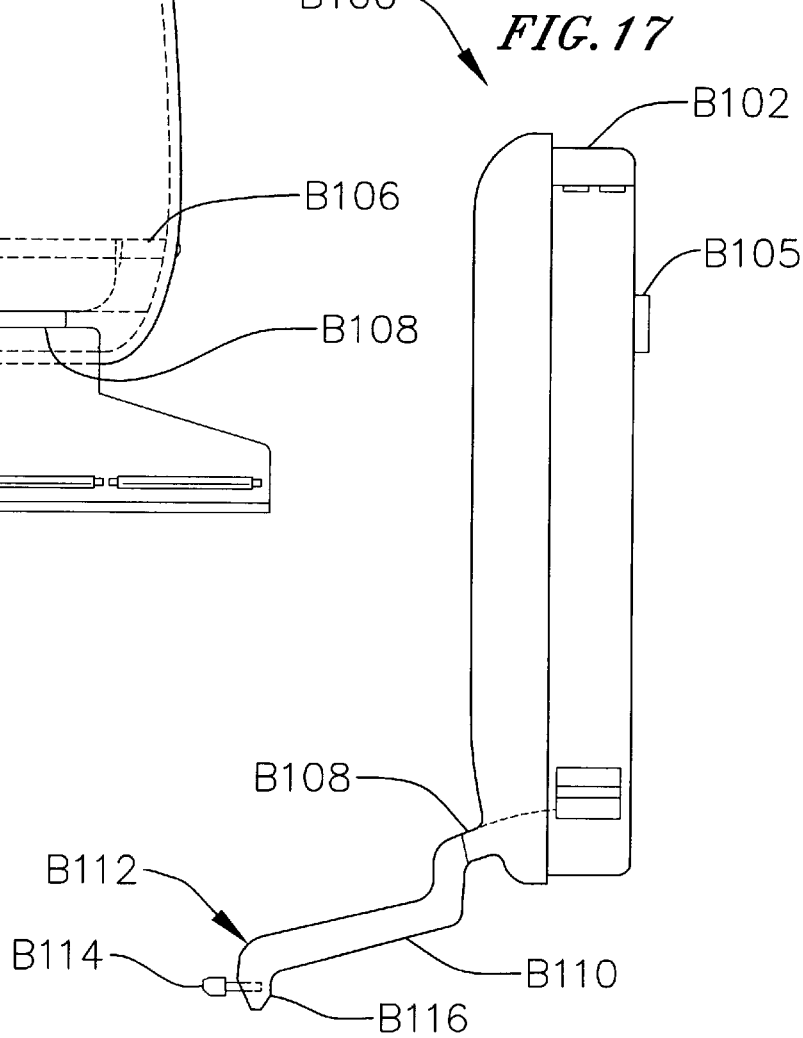
FIG. 17 is a side view of the vacuum cleaner attachment illustrated in FIG. 16.

In accordance with the third preferred embodiment of the present invention, as shown in FIGS. 16 and 17, there is also provided an air return accessory B100 for attachment to an existing vacuum cleaner. The air return accessory B100 comprises a front housing B102 that is attachable to the upright portion of an existing vacuum cleaner such as an Eureka World VAC. Specifically, the front housing B102 replaces the existing upright body cover and disposable bag of the vacuum cleaner. The front housing B102 snaps into the upright portion using a standard spring loaded handle/clip apparatus (not shown). The front housing B102 contains an airtight accessory dustbin B104 that is coupled to the inlet of the existing vacuum cleaner through adaptive orifice B105. The input air flows through the dustbin B104 and is filtered by an accessory filter B106 before exiting the dustbin B104 through accessory exhaust opening B108. An accessory outlet B110 is coupled to the accessory exhaust B108 in order to direct the exhaust toward the existing air inlet of the vacuum cleaner. The accessory outlet B110 has a forward lip B112 that projects downwardly in front of the air inlet of the existing vacuum cleaner. Additionally, the accessory outlet B110 is configured with an accessory edge detection button B114 that directs the output stream either forward or rearward. The accessory outlet B110 and accessory edge detection button B114 operate identically to the edge detection button B66 and outlet B58 of the vacuum B10. The accessory edge detection button B144 will direct the exhaust stream rearward through an accessory rear channel B116 during normal operation and forward through an accessory forward channel B118 when the accessory outlet B110 is in contact with a wall or obstruction and the accessory edge detection button B114 is depressed. When the accessory dustbin B104 has been filled with dust and debris, it may be emptied through a hinged lid (not shown).

The above-described vacuum cleaners, as well as other vacuum cleaners, may be modified such that the low pressure air stream that picks up dirt and debris is ultimately combined with another air stream generated using air from outside the vacuum (i.e. "ambient air") to increase the pressure and/or volume of the air stream used to agitate, or otherwise facilitate removal of, the dirt and debris.

Figure 18:
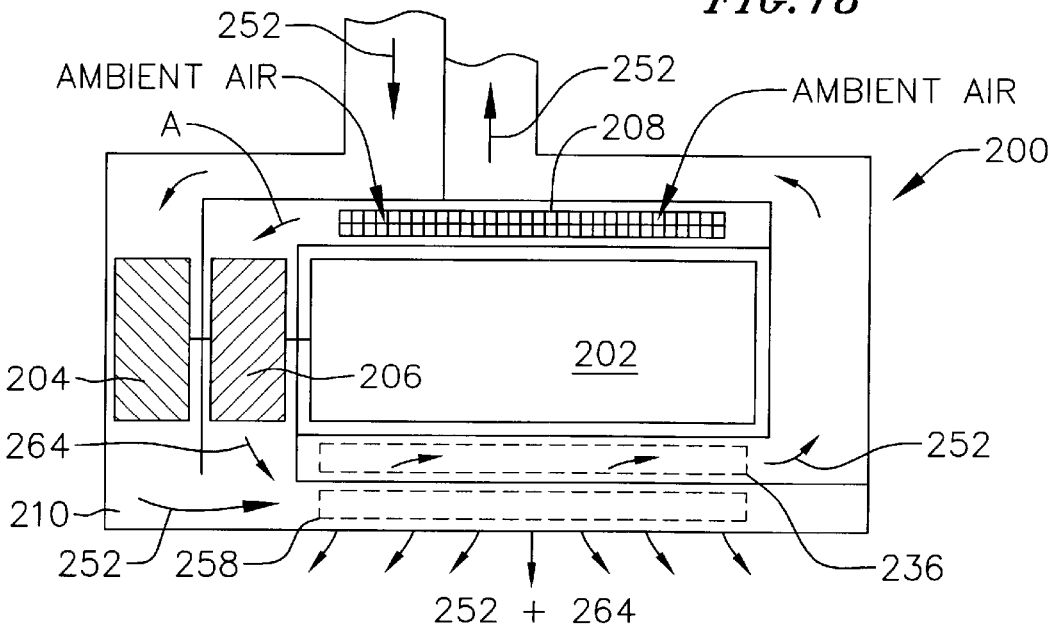
FIG. 18 is a diagrammatic view of a motor assembly and air transmission arrangement in accordance with a preferred embodiment of a present invention.

As illustrated for example in FIG. 18, an exemplary motor assembly 200 that may be used in conjunction with, for example, vacuums 10 and B10 and attachments 100 and B100 illustrated in FIGS. 1–6 and 12–17, includes a motor 202 and a fan 204. Rotation of the fan 204 generates a low pressure intake air stream 252 that draws air, dirt and debris through an inlet 236 (such as one of the inlets 36 and B36) and a conduit (such as one of hoses 42 and B42) to a dustbin (such as one of the dustbins 44 and B44). The motor assembly 200 also includes a fan 206 that generates a high pressure output air stream 264 with ambient air A that is drawn through an ambient air intake port 208. The high pressure output air stream 264 is directed through an exhaust port (such as one of the exhaust ports 57 and B57) to an outlet 258 (such as one of the outlets 58 and B58). The low pressure intake air stream 252 is filtered, returned from the dustbin, and combined with the high pressure output air stream 264 in a chamber 210 that is located downstream of the fan 206. Thus, the air stream exiting through the outlet 258 is a combined air stream 252+264 that includes both the low pressure intake air stream 252 and the high pressure output air stream 264.

Figure 19:
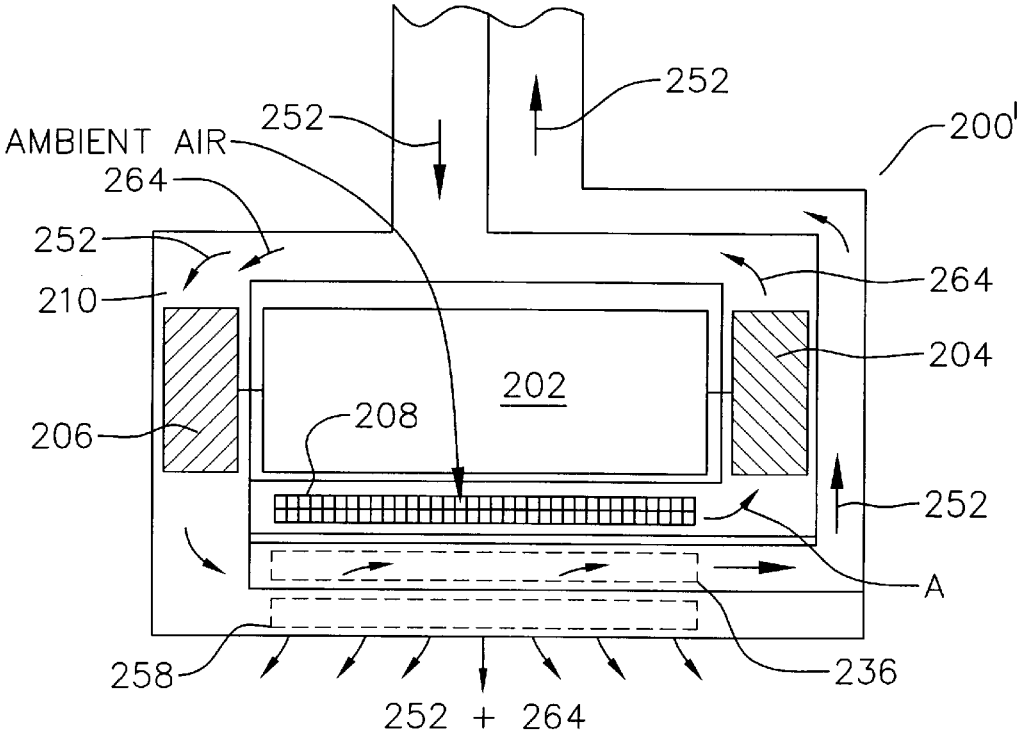
FIG. 19 is a diagrammatic view of a motor assembly and air transmission arrangement in accordance with a preferred embodiment of a present invention.

The exemplary motor assembly 200' illustrated in FIG. 19 is substantially similar to the motor assembly 200 illustrated in FIG. 18 and similar reference numerals are used to identify similar components. The exemplary motor assembly 200', which includes a motor 202, fans 204 and 206, an ambient air intake port 208, a chamber 210, an inlet 236, and an outlet 258, may also be used with, for example, the vacuums 10 and B10 and attachments 100 and B100 illustrated in FIGS. 1–6 and 12–17. Here, however, the chamber 210 is located upstream of the fan 206 such that the high pressure output stream 264 is combined with the low pressure intake air stream 252 prior to being drawn into the fan 206.

Figure 20:
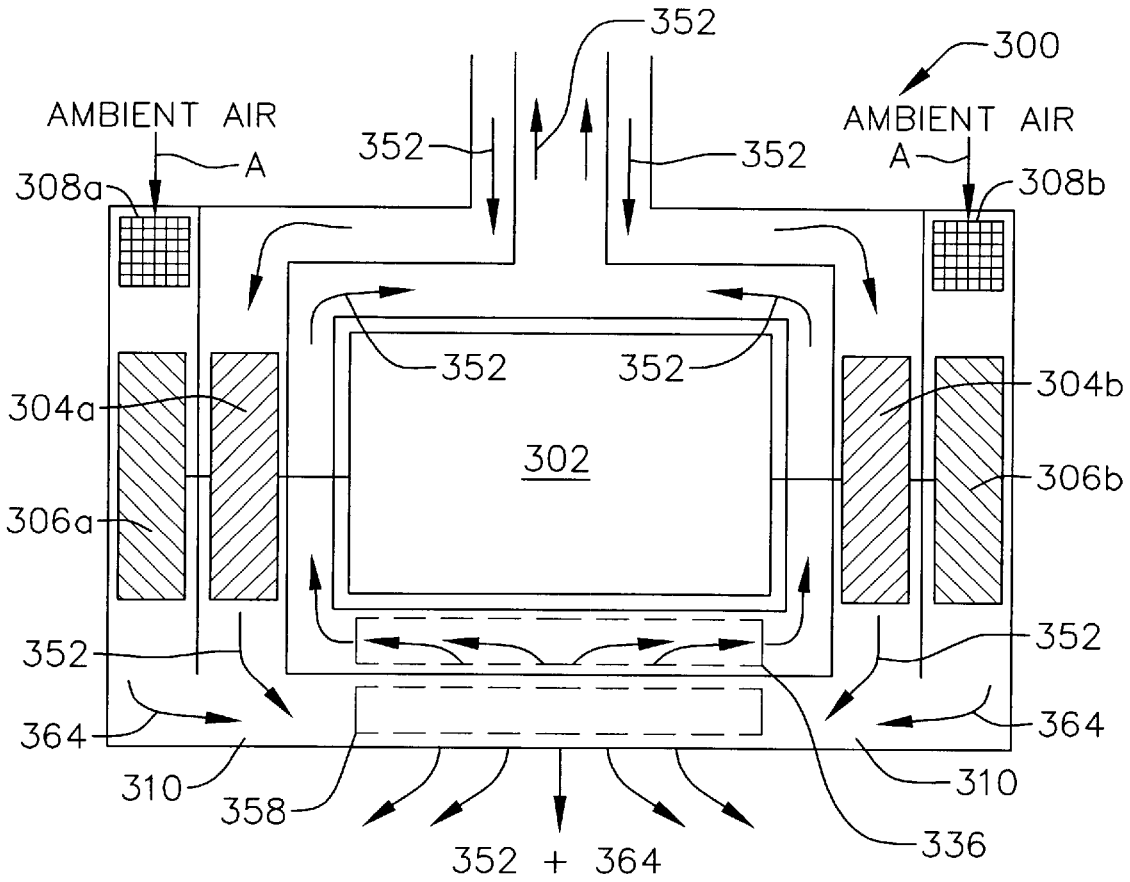
FIG. 20 is a diagrammatic view of a motor assembly and air transmission arrangement in accordance with a preferred embodiment of a present invention.

Turning to FIG. 20, an exemplary motor assembly 300 that may be used in conjunction with, for example, vacuum A10 illustrated in FIGS. 7–11, includes a motor 302 and a pair of fans 304*a* and 304*b*. Rotation of the fans 304*a* and 304*b* generates low pressure intake air streams 352 that draw air, dirt and debris through an inlet 336 (such as the inlet A36) and a conduit (such as the duct A50) to a dustbin (such as the dustbin A44). The motor assembly 300 also includes a pair of fans 306*a* and 306*b* that generate high pressure output air streams 364 with ambient air A that is drawn through ambient air intake ports 308*a* and 308*b*. The high pressure output air stream 364 are directed through an exhaust port (such as the exhaust port A57) to an outlet 358 (such as the outlet A58). The low pressure intake air streams 352 are returned from the dustbin by way of a filter and then combined with the high pressure output air streams 364 in a chamber 310 that is located downstream of the fans 306*a* and 306*b*. Thus, the air stream exiting through the outlet 358 is a combined air stream 352+364 that includes both the low pressure intake air streams 352 and the high pressure output air streams 364.

Figure 11:
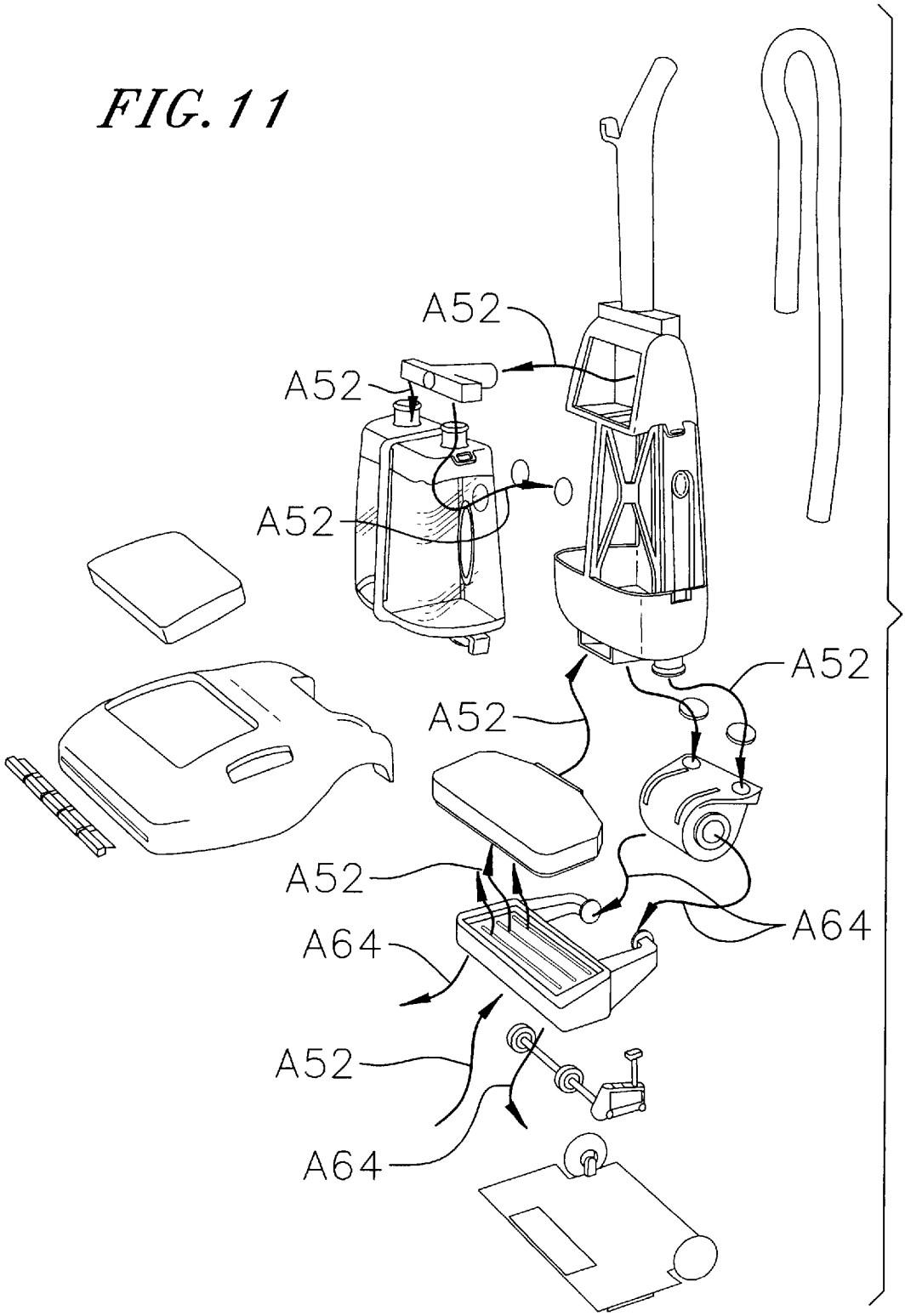
FIG. 11 is an exploded perspective view showing the air flow path through the vacuum cleaner illustrated in FIG. 7.
Figure 21:
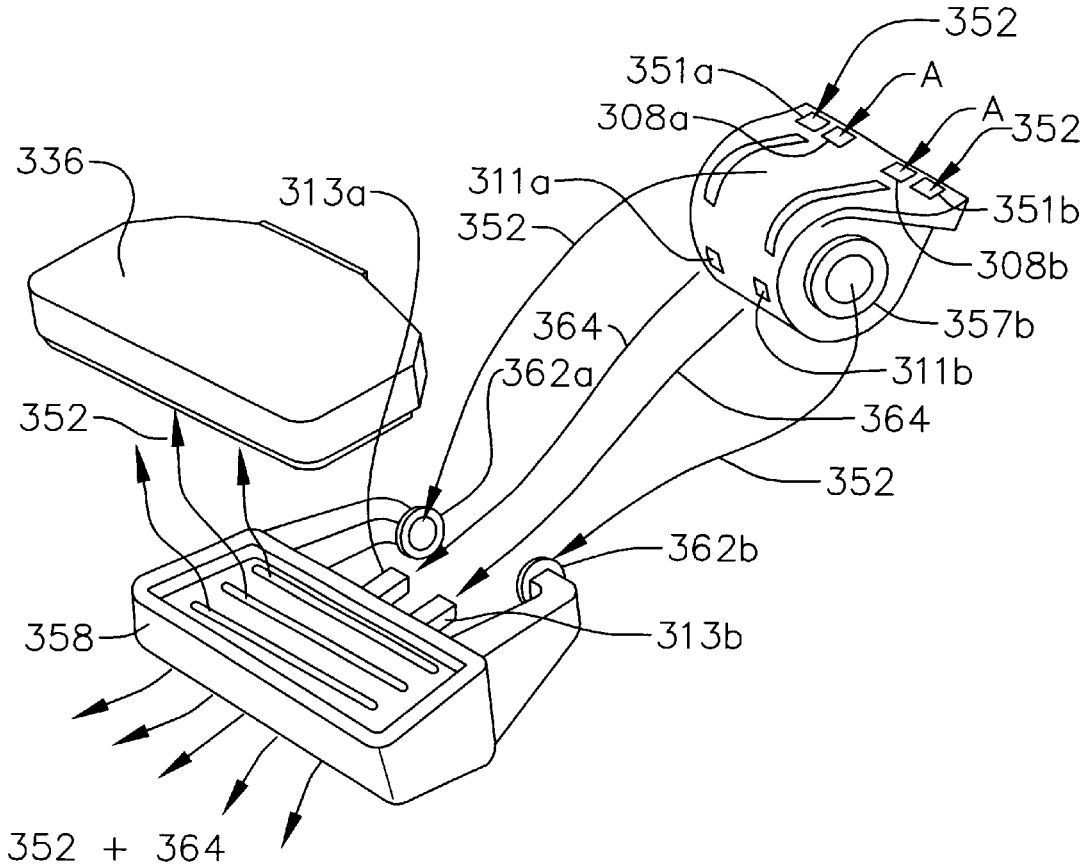
FIG. 21 is an exploded view of the motor assembly and air transmission arrangement illustrated in FIG. 20.
Figure 22:
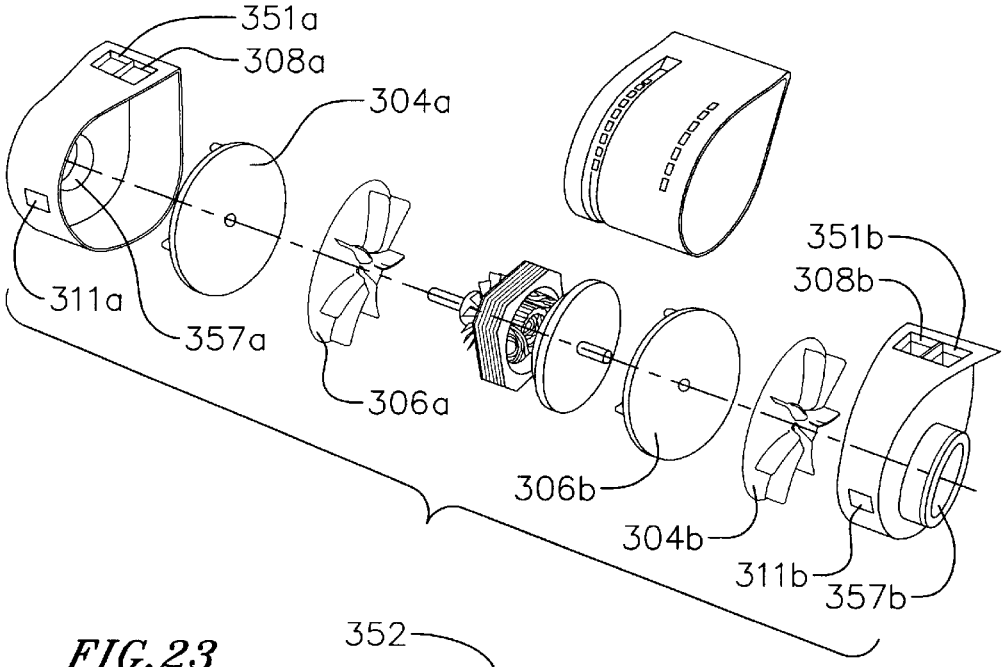
FIG. 22 is an exploded view of the motor assembly illustrated in FIG. 20.
Figure 23:
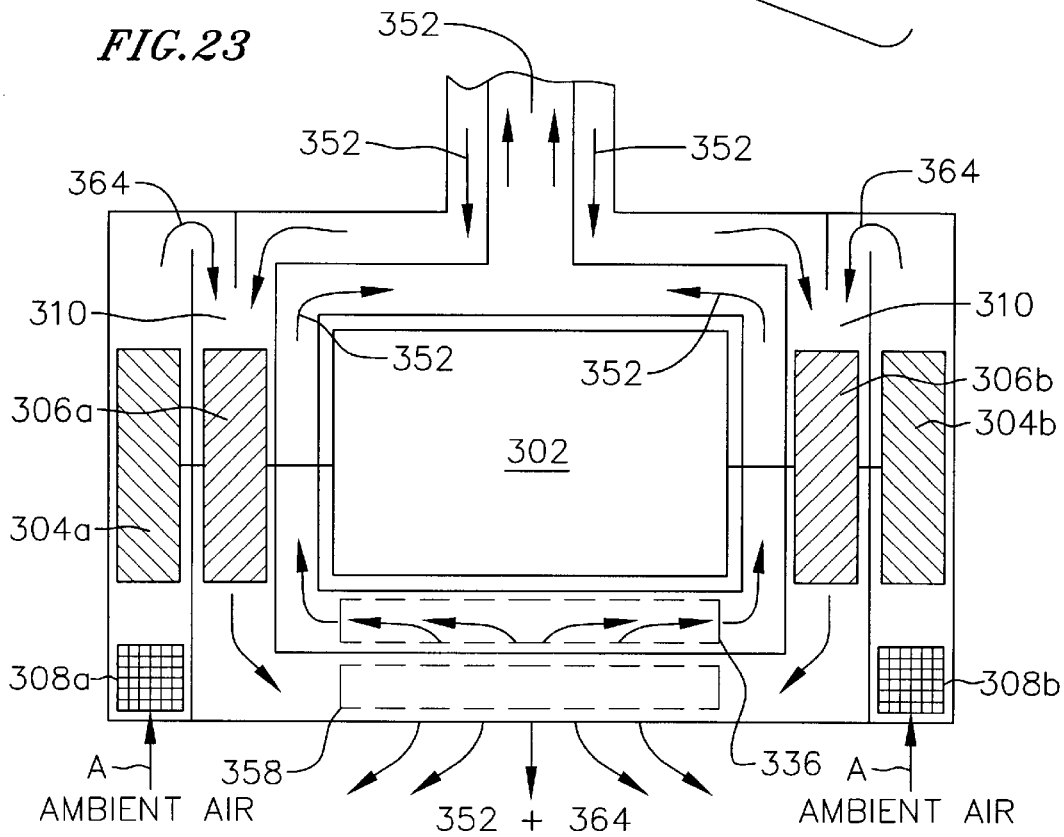
FIG. 23 is a diagrammatic view of a motor assembly and air transmission arrangement in accordance with a preferred embodiment of a present invention.

As illustrated FIGS. 21 and 22, one exemplary motor assembly 300 configuration is a variation of the motor assembly illustrated in FIGS. 8, 10 and 11. More specifically, in addition to the ambient air intake ports 308*a* and 308*b*, the motor assembly housing includes a pair of intakes 351*a* and 351*b* which are connected to the dustbin and receive the low pressure intake air streams 352. A pair of exhaust ports 357*a* and 357*b* are also provided. The low pressure intake air streams 352 travel through the intakes 351*a* and 351*b* to exhaust ports 357*a* and 357*b* via conduits (not shown) and to the upper portions 362*a* and 362*b* of the outlet 358. The ambient air A, which enters the motor assembly 300 by way of ambient air intake ports 308*a* and 308*b*, is driven by the fans 306*a* and 306*b* through outlet ports 311*a* and 311*b* to produce the high pressure output air streams 364. The outlet ports 311*a* and 311*b* are connected to intake ports 313*a* and 313*b* on the outlet 358. The low pressure intake air streams 352 and high pressure output air streams 364 then enter the chamber 310, which is within the outlet 358, prior to exiting via an opening in the outlet in the manners described above.

The exemplary motor assembly 300' illustrated in FIG. 22 is substantially similar to the motor assembly 300 illustrated in FIG. 20 and similar reference numerals are used to identify similar components. The exemplary motor assembly 300', which includes a motor 302, fans 304 and 306, an ambient air intake port 308, a chamber 310, an inlet 336, and an outlet 358, may also be used with, for example, the vacuum A10 illustrated in FIGS. 7–11. Here, however, a pair of chambers 310 are located upstream of the fans 306*a* and 306*b* such that the high pressure output air streams 364 are combined with the low pressure intake air streams 352 prior to being drawn into the fans 304*a* and 304*b*.

It should be noted that although the fans 204/206 and fans 204*a–b*/206*a–b* in the exemplary embodiments illustrated in FIGS. 18–23 rotate in the same directions, the present inventions are not so limited. The exemplary motor assemblies may also be reconfigured such that the fans 204/206 and fans 204*a–b*/206*a–b* rotate in different directions.

Although the present inventions have been described in terms of the preferred embodiments above, numerous modifications and/or additions to the above-described preferred embodiments would be readily apparent to one skilled in the art. By way of example, but not limitation, the present inventions may be incorporated into canister-type vacuum cleaners. It is intended that the scope of the present inventions extends to all such modifications and/or additions.

What is claimed is:

1. A vacuum cleaner for cleaning a surface, comprising:
   - a motor assembly including a motor, an ambient air intake port, an air intake port, and an air exhaust port;
   - a first air transmission apparatus, operably connected to the air intake port, including a first air inlet adjacent to the surface and operably connected to a debris collection area and a first air outlet;
   - a second air transmission apparatus, operably connected to the air exhaust port, including a second air outlet that directs air from the air exhaust port to the surface; and
   - a chamber, operably connected to the first air outlet, that combines the air from the first air outlet with ambient air from the ambient air intake port.

2. A vacuum cleaner as claimed in claim 1, wherein the first air inlet comprises a low pressure air inlet.

3. A vacuum cleaner as claimed in claim 1, wherein the second air outlet comprises a high pressure air outlet.

4. A vacuum cleaner as claimed in claim 1, wherein the motor assembly includes a first fan associated with the air intake port and a second fan associated with the ambient air intake port.

5. A vacuum cleaner as claimed in claim 1, wherein the motor assembly includes a first pair of fans associated with the air intake port and a second pair of fans associated with the ambient air intake port.

6. A vacuum cleaner as claimed in claim 1, further comprising:
   - a filter in fluid communication with the first air outlet.

7. A vacuum cleaner as claimed in claim 1, wherein the chamber is located upstream of at least a portion of the motor assembly.

8. A vacuum cleaner as claimed in claim 1, wherein the chamber is located downstream of the motor assembly.

9. A vacuum cleaner as claimed in claim 1, wherein the vacuum outlet further comprises:
   - a forward deflection channel;
   - a plurality of rearward deflection channels; and
   - a selector configured to selectively connect the air exhaust port to one of the forward deflection channel and the rear deflection channels.

10. A vacuum cleaner as claimed in claim 1, further comprising:
   - a forward deflection channel;
   - a rear deflection channel; and
   - a selector configured to selectively connect the air exhaust port to one of the forward deflection channel and the rear deflection channel.

11. A vacuum cleaner as claimed in claim 10, wherein the forward deflection channel directs the air in front of the vacuum cleaner.

12. A vacuum cleaner as claimed in claim 1, further comprising:

a brush defining a perimeter that substantially surrounds the first air intake and the second air outlet.

13. A method of cleaning a surface, comprising the steps of:

drawing an intake air stream through an intake air inlet adjacent to the surface;

directing the intake air stream through a debris collection area;

drawing ambient air;

generating an output air stream with the ambient air;

combining the intake air stream with the output air stream to form a combined air stream; and directing the combined air stream through an output outlet adjacent to the surface.

14. A method as claimed in claim 13, further comprising the step of:

filtering the intake air stream prior to combining the intake air stream with the output air stream.

15. A method as claimed in claim 13, wherein the step of directing the combined air stream through an output outlet adjacent to the surface comprises directing the combined air stream adjacent to the intake air inlet with a rear deflection channel.

16. A method as claimed in claim 13, wherein the step of directing the combined air stream through an output outlet adjacent to the surface comprises directing the combined air stream adjacent to the intake air inlet with a forward deflection channel.

17. A method as claimed in claim 13, wherein the step of drawing an intake air stream through an intake air inlet comprises generating the intake air stream with at least one fan.

18. A method as claimed in claim 13, wherein the step of generating an output air stream with the ambient air comprises generating the output air stream with at least one fan.

19. A method as claimed in claim 18, wherein the step of combining the intake air stream with the output air stream comprises combining the intake air stream with the output air stream upstream of the at least one fan.

20. A method as claimed in claim 18, wherein the step of combining the intake air stream with the output air stream comprises combining the intake air stream with the output air stream downstream from the at least one fan.

21. A method as claimed in claim 13, wherein the step of generating an output air stream with the ambient air stream comprises generating a high pressure output air stream.

22. A method as claimed in claim 13, wherein the step of drawing an intake air stream comprises drawing a low pressure intake air stream.

* * * * *